US006481468B1

(12) United States Patent
Taggart

(10) Patent No.: US 6,481,468 B1
(45) Date of Patent: Nov. 19, 2002

(54) APPARATUS AND METHOD FOR PROVIDING CONTAINER FILLING IN AN ASEPTIC PROCESSING APPARATUS

(75) Inventor: Thomas D. Taggart, South Wales, NY (US)

(73) Assignee: Steuben Foods Incorporated, Elma, NY (US)

( * ) Notice: Subject to any disclaimer, the term of this patent is extended or adjusted under 35 U.S.C. 154(b) by 0 days.

(21) Appl. No.: 09/781,636

(22) Filed: Feb. 12, 2001

Related U.S. Application Data

(63) Continuation-in-part of application No. 09/376,992, filed on Aug. 18, 1999, now Pat. No. 6,209,591.
(60) Provisional application No. 60/118,404, filed on Feb. 2, 1999.

(51) Int. Cl.[7] ..... B65B 1/04
(52) U.S. Cl. ..... 141/85; 141/90; 141/93; 141/301; 134/169 R
(58) Field of Search ..... 141/85, 89–93, 141/4–7, 37, 39, 40, 301, 97, 172, 129, 275–278, 48, 63; 134/169 R, 169 C, 166 C

(56) References Cited

U.S. PATENT DOCUMENTS

| | | | | |
|---|---|---|---|---|
| 3,604,480 A | * | 9/1971 | Reichert et al. | 141/198 |
| 4,557,301 A | * | 12/1985 | Jorss | 141/102 |
| 4,569,378 A | | 2/1986 | Bergandy | |
| 4,597,242 A | * | 7/1986 | Hendriks et al. | 426/399 |
| 5,127,625 A | | 7/1992 | Kleinhappl | |
| 5,259,416 A | | 11/1993 | Kunz et al. | |
| 5,267,591 A | * | 12/1993 | Wakabayashi et al. | 141/85 |
| 5,445,194 A | | 8/1995 | Clusserath | |

OTHER PUBLICATIONS

Bosch Product Literature: "Aseptically operating filling and closing lines for bottles, jars and wide–mouth containers of glass" 4 pages, (No Date).

* cited by examiner

*Primary Examiner*—Steven O. Douglas
(74) *Attorney, Agent, or Firm*—Schmeiser, Olsen & Watts

(57) ABSTRACT

An apparatus and method for filling aseptic containers with an aseptic product in an aseptic processing apparatus. An apparatus including a valve mechanism for controlling the opening or closing of a valve. The aseptic product is delivered through the valve to the aseptic container. The valve mechanism remains in a sterile tunnel, preventing contaminants from being carried into the aseptic product.

35 Claims, 31 Drawing Sheets

APPARATUS AND METHOD FOR PROVIDING CONTAINER FILLING IN AN ASEPTIC PROCESSING APPARATUS

The present patent application is a continuation-in-part of copending U.S. patent application Ser. No.: 09/376,992, filed Aug. 18, 1999 now U.S. Pat. No. 6,209,591; and provisional U.S. patent application Ser. No.: 60/118,404, filed Feb. 2, 1999 and entitled "Apparatus and method for providing container filling in an aseptic processing apparatus."

FIELD OF THE INVENTION

The present invention relates generally to systems for the aseptic packaging of food products. More particularly, the present invention relates to an apparatus and method for providing container product filling in an aseptic processing apparatus.

BACKGROUND OF THE INVENTION

Sterilized packaging systems in which a sterile food product is placed and sealed in a container to preserve the product for later use are well known in the art. Methods of sterilizing incoming containers, filling the containers with pasteurized product, and sealing the containers in an aseptic sterilization tunnel are also known.

Liquid product fillers are known in the art. Generally, a container is placed under a filler head. The filler head opens and dispenses the liquid product. When the container is filled to a desired level, the filler head closes and stops the flow of liquid product into the container. Commonly, in line aseptic fillers use completely mechanical devices for measuring and dosing product into containers. These devices include a first apparatus for measuring the amount of material to be dispensed, and a second apparatus which functions as a filling nozzle. Typically, the first apparatus includes a piston cylinder apparatus for measuring the amount of material. The amount of material measured by the piston cylinder apparatus is limited by the diameter and stroke of the piston. The first and second apparatus include complicated mechanical members which are difficult to sterilize, clean, and maintain.

Typically, rotary fillers include multiple filling stations and allow about 7 to 15 seconds for filling. Some of the rotary bottle filers use electronic measuring devices for dosing the desired amount of product into a bottle. In order to meet FDA (Food and Drug Administration) "aseptic" standards and 3A Sanitary Standards, all surfaces of the filler that come into contact with the liquid product must be sterilized. Before filling commences, a plurality of interior parts of the filler must be removed, sterilized, and replaced. This time consuming and expensive process is necessary in order to ensure the complete sterilization of all surfaces that come into contact with the liquid product.

Packaged food products can generally be categorized as high acid products (Ph below 4.5) or low acid products (Ph of 4.5 and above). The high acid content of a high acid product helps to reduce bacteria growth in the product, thereby increasing the shelf life of the product. The low acid content of a low acid product, however, necessitates the use of more stringent packaging techniques, and often requires refrigeration of the product at the point of sale.

Several packaging techniques, including extended shelf life (ESL) and aseptic packaging, have been developed to increase the shelf life of low acid products. During ESL packaging, for example, the packaging material is commonly sanitized and filled with a product in a presterilized tunnel under "ultra-clean" conditions. By using such ESL packaging techniques, the shelf life of an ESL packaged product is commonly extended from about 10 to 15 days to about 90 days. Aseptic packaging techniques, however, which require that the packaging take place in a sterile environment, using presterilized containers, etc., are capable of providing a packaged product having an even longer shelf life of 150 days or more. In fact, with aseptic packaging, the shelf life limitation is often determined by the quality of the taste of the packaged product, rather than by a limitation caused by bacterial growth.

For the aseptic packaging of food products, an aseptic filler must, for example, use an FDA (Food and Drug Administration) approved sterilant, meet FDA quality control standards, use a sterile tunnel or clean room, and must aseptically treat all packaging material. The food product must also be processed using an "Ultra High Temperature" (UHT) pasteurization process to meet FDA aseptic standards. The packaging material must remain in a sterile environment during filling, closure, and sealing operations.

Many attempts have been made, albeit unsuccessfully, to aseptically fill containers, such as bottles or jars having small openings, at a high output processing speed. In addition, previous attempts for aseptically packaging a low acid product in plastic bottles or jars (e.g., formed of polyethylene terepthalate (PET) or high density polyethylene (HDPE)), at a high output processing speed, have also failed. Furthermore, the prior art has not been successful in providing a high output aseptic filler that complies with the stringent United States FDA standards for labeling a packaged product as "aseptic." In the following description of the present invention, the term "aseptic" denotes the United States FDA level of aseptic.

SUMMARY OF THE INVENTION

In order to overcome the above deficiencies, the present invention provides an apparatus and method for providing container product filling in an aseptic processing apparatus. Additionally, the present invention provides both a "Clean In Place" (CIP) process for cleaning, and a "Sterilizing in Place" for sterilizing all of the interior surfaces of the filler without having to disassemble the filler. The filler apparatus includes a smooth filling tube which is easy to clean and sterilize. The filler apparatus is used in a system for providing aseptically processed low acid products in a container having a small opening, such as a glass or plastic bottle or jar, at a high output processing speed. Many features are incorporated into the filler apparatus in order to meet various FDA aseptic standards and 3A Sanitary Standards and Accepted Practices.

The present invention generally provides an apparatus comprising:

- a sterile tunnel for surrounding a plurality of aseptically sterilized containers with pressurized sterile air;
- a valve head for controlling the flow of an aseptically sterilized product by opening and closing an outlet port of a nozzle carrying the aseptically sterilized product;
- a first end of a valve stem attached to the valve head;
- a second end of the valve stem attached to a valve actuator system for displacing the valve stem;
- an opening in a wall of the sterile tunnel through which the valve stem passes; and
- a flexible diaphragm attached to the valve stem and to an outer peripheral portion of the opening in the wall of the sterile tunnel for preventing contaminants from passing into the sterile tunnel through the opening in the wall of the sterile tunnel.

The present invention provides another embodiment of the apparatus comprising:

a sterile tunnel for surrounding a plurality of aseptically sterilized containers with pressurized sterile air;

a nozzle for carrying an aseptically sterilized product into the sterile tunnel;

a valve head for controlling the flow of aseptically sterilized product by opening and closing an outlet port of the nozzle;

a first end of a valve stem attached to the valve head;

a second end of the valve stem attached to a sealed actuator system for displacing the valve stem, wherein the valve head, the valve stem and the sealed actuator system are surrounded by the sterile tunnel;

a control conduit connecting the sealed actuator system with a control system;

an opening in a wall of the sterile tunnel through which the control conduit passes; and a sealing member for sealing the control conduit within the opening in the wall of the sterile tunnel.

The present invention provides another embodiment of the apparatus comprising:

a sterile tunnel for surrounding a plurality of aseptically sterilized containers with pressurized sterile air;

a valve for controlling the flow of an aseptically sterilized product through an outlet port of a nozzle;

a plurality of flow passages formed between an inner wall of the nozzle and a plurality of indentations on an outer surface of the valve, wherein the plurality of flow passages transport the aseptically sterilized product to the outlet port;

a valve seat in the nozzle for stopping the flow of aseptically sterilized product through the plurality of flow passages;

a sealed actuator system for displacing the valve into an open position; and a control conduit connecting the sealed actuator system with a control system.

The present invention provides a method comprising:

controlling the flow of an aseptic product using a valve;

surrounding a region where the aseptic product exits the valve with a sterile region; and controlling the opening or closing of the valve with a sealed actuator, wherein the sealed actuator is surrounded with the sterile region.

The present invention provides another method comprising:

controlling the flow of an aseptic product through a nozzle using a valve;

surrounding a region where the aseptic product exits the valve with a sterile region; and displacing the valve with an electromagnetic actuator, wherein an electrical current applied to the electromagnetic actuator displaces the valve into an open position allowing the aseptic product to flow through an outlet port of the nozzle.

BRIEF DESCRIPTION OF THE DRAWINGS

The features of the present invention will best be understood from a detailed description of the invention and a preferred embodiment, thereof selected for the purposes of illustration, and shown in the accompanying drawings in which.

DETAILED DESCRIPTION OF THE INVENTION

Figure 1:
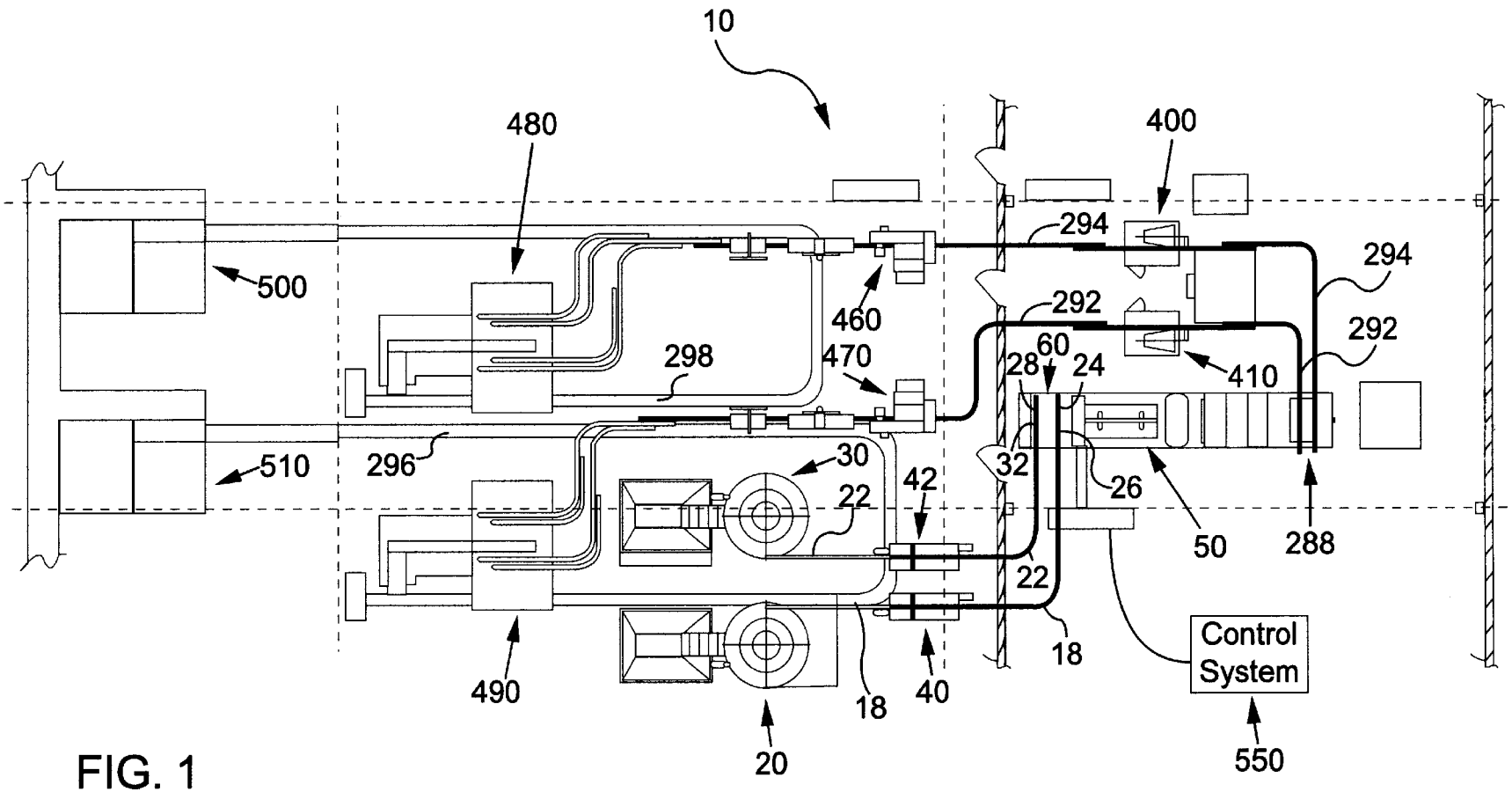
FIG. 1 is a plan view of an aseptic processing apparatus in accordance with a preferred embodiment of the present invention.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the preferred embodiment. The features and advantages of the present invention are illustrated in detail in the accompanying drawings, wherein like reference numerals refer to like elements throughout the drawings. Although the drawings are intended to illustrate the present invention, the drawings are not necessarily drawn to scale.

The present invention provides an aseptic processing apparatus 10 that will meet the stringent United States FDA (Food and Drug Administration) requirements and 3A Sanitary Standards and Accepted Practices required to label a food product (foodstuffs) as "aseptic." Hereafter, "aseptic" will refer to the FDA level of aseptic. The present invention provides an aseptic processing apparatus 10 for producing at least about a 12 log reduction of *Clostridium botulinum* in food products. In addition, the present invention produces packaging material with at least about a 6 log reduction of spores. Actual testing of the aseptic processing apparatus is accomplished with spore test organisms. These test organisms are selected on their resistance to the media selected used to achieve sterility. For example, when steam is the media, the test organism is *Bacillus stearothermophilus*. When hydrogen peroxide is the media, then the test organism is *Bacillus subtilis var. globigii*.

The present invention processes containers such as bottles or jars that have a small opening compared to its height and its greatest width (e.g., the ratio of the opening diameter to the height of the container is less than 1.0). In the preferred embodiment, a bottle 12 (see, e.g., FIG. 8) is illustrated as the container. The container may alternately comprise a jar. The bottle 12 is preferably formed of a plastic such as polyethylene terepthalate (PET) or high density polyethylene (HDPE), although other materials such as glass may also be used. The present invention uses an aseptic sterilant such as hydrogen peroxide ($H_2O_2$) or oxonia (hydrogen peroxide and peroxyacetic acid) to sterilize the bottles 12. In the preferred embodiment of the present invention, hydrogen peroxide is used as the sterilant. The present invention uses hydrogen peroxide with a concentration of less than about 35% and ensures that the bottles 12 have less than about 0.5 ppm of residual hydrogen peroxide after each bottle 12 is sterilized.

Figure 2:
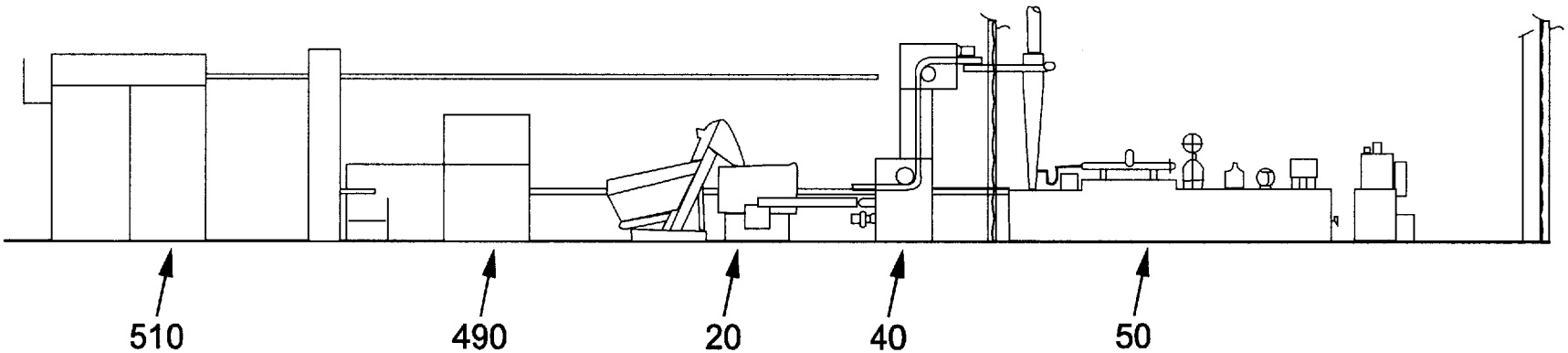
FIG. 2 is a side view of the aseptic processing apparatus of FIG. 1.
Figure 3:
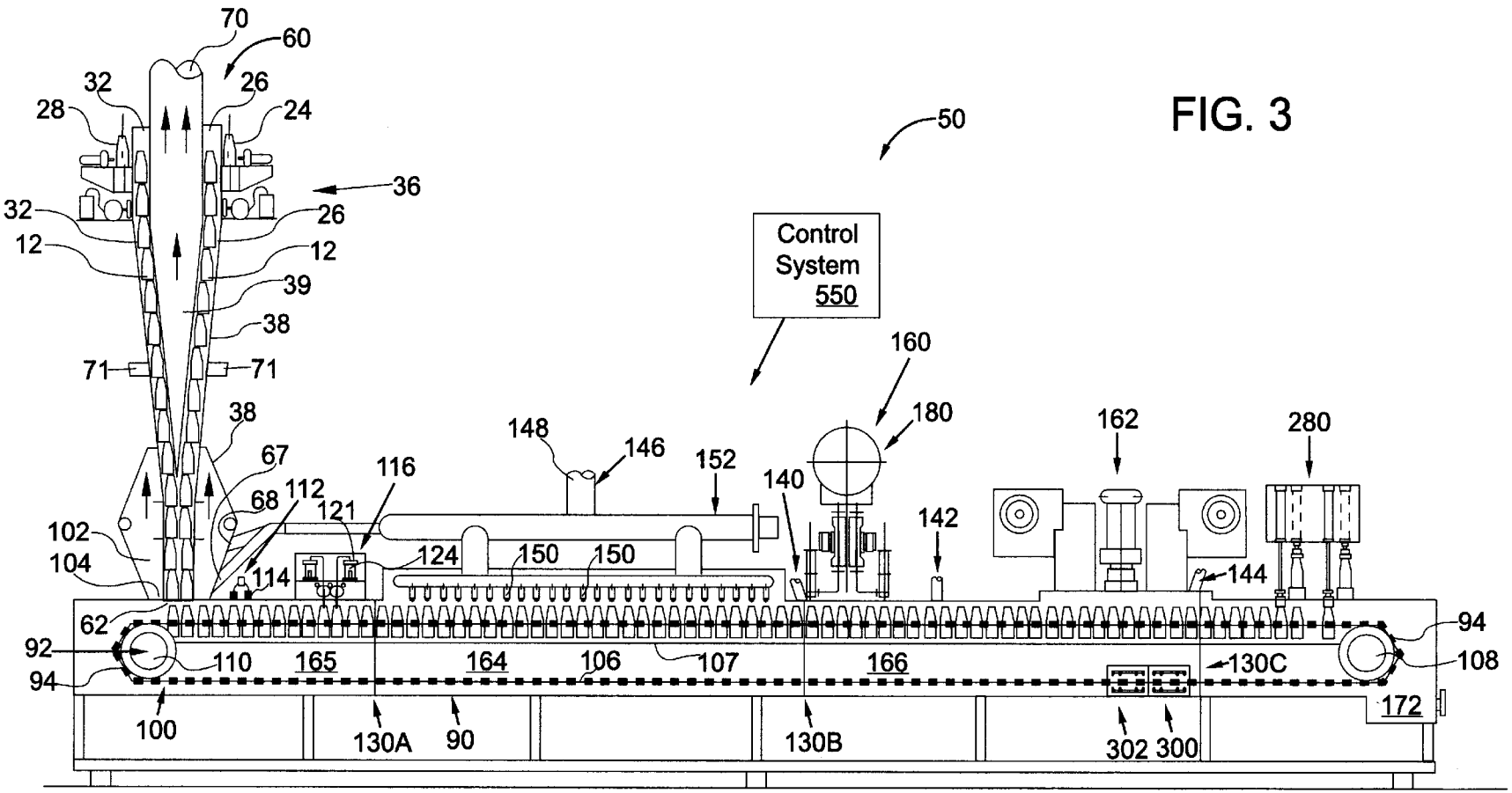
FIG. 3 is a partial cross-sectional side view of the aseptic processing apparatus of FIG. 1.

FIGS. 1—3 illustrate several views of an aseptic processing apparatus 10 in accordance with a preferred embodiment of the present invention. As shown, the aseptic processing apparatus 10 includes a first bottle unscrambler 20, a second bottle unscrambler 30, and a bottle lifter 40 for providing a supply of properly oriented empty bottles. The empty bottles are delivered to a filler apparatus 50 after passing through a bottle infeed and sterilization apparatus 60 for aseptic sterilization. The filled bottles are sealed at a first capping apparatus 400 or a second capping apparatus 410. A control system 550 monitors and controls the operation of the aseptic processing apparatus 10. The filled and sealed bottles are packed and palletized using a first case packing apparatus 480, a second case packing apparatus 490, a first palletizer 500, and a second palletizer 510.

The bottles 12 arrive at a first bottle unscrambler 20 with a random orientation, such that an opening 16 (see FIG. 8) of each bottle 12 can be oriented in any direction. The first bottle unscrambler 20 manipulates the bottles 12 until the opening 16 of each bottle 12 is in a top vertical position. The bottles 12 leave the first bottle unscrambler 20 in a series formation with the opening 16 of each bottle 12 oriented vertically. The bottles 12 travel in single file in a first lane 18 to a first bottle lifter 40. The first bottle lifter 40 lifts and transports the bottles 12 to a bottle infeed and sterilization apparatus 60. A second bottle unscrambler 30 may also used to provide a supply of vertically oriented bottles 12. The bottles 12 output from the second bottle unscrambler 30 travel in single file in a second lane 22 to a second bottle lifter 42, which lifts and transports the bottles 12 to the bottle infeed and sterilization apparatus 60.

Figure 4:
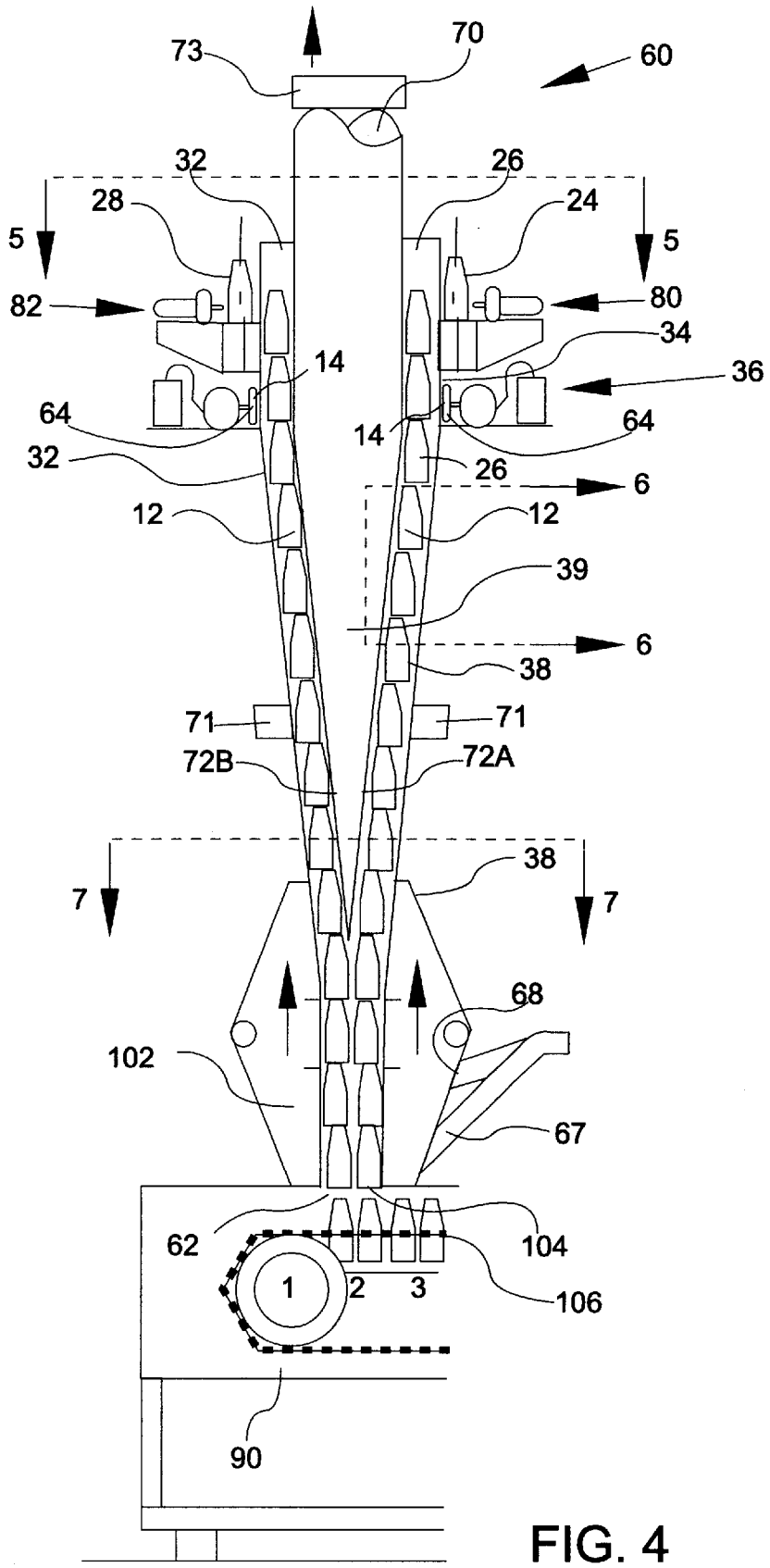
FIG. 4 is a cross-sectional side view of a bottle infeed and sterilization apparatus.
Figure 5:
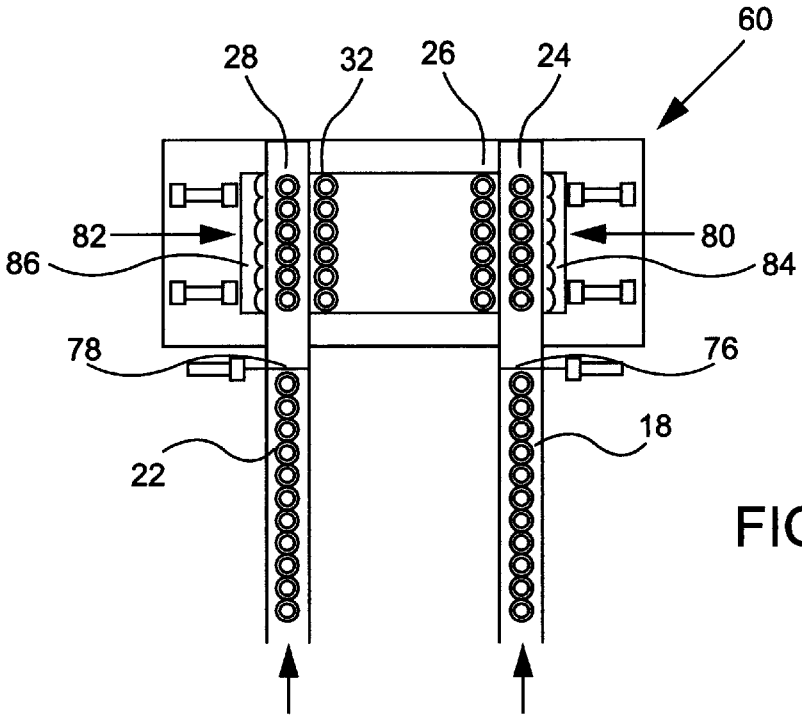
FIG. 5 illustrates a cross-sectional top view of the bottle infeed and sterilization apparatus taken along line 5—5 of FIG. 4.

FIG. 3 illustrates the bottle infeed, sterilization, and conveying apparatus 60 attached to the filler apparatus 50. FIG. 4 illustrates a cross-sectional side view of the bottle infeed, sterilization, and conveying apparatus 60. FIG. 5 illustrates a cross-sectional top view of the bottle infeed, sterilization, and conveying apparatus 60 taken along line 5—5 of FIG. 4. The bottle infeed and sterilization apparatus 60 preferably inputs six bottles 12 in a horizontal direction from the first lane 18 and six bottles in a horizontal direction from the second lane 22 (FIG. 5). A gate 76 in the first lane 18 selectively groups six bottles 12 at a time in first horizontal row 24. A gate 78 in the second lane 22 selectively groups six bottles 12 at a time in a second horizontal row 28. An infeed apparatus 80 includes a pushing element 84 for pushing the bottles 12 in the first horizontal row 24 into a first vertical lane 26. A corresponding infeed apparatus 80 includes a pushing element 86 for pushing the bottles 12 in the second horizontal row 28 into a second vertical lane 32. The six bottles 12 in the first vertical lane 26 and the six bottles 12 in the second vertical lane 32 are directed downward into the bottle infeed and sterilization apparatus 60.

Referring to FIG. 4, as the bottles 12 move downward in the first vertical lane 26 and the second vertical lane 32, a sterilant 14, such as heated hydrogen peroxide, oxonia, or other aseptic sterilant, is applied to an outside surface 34 of each bottle 12 by a sterilant application apparatus 36. The outside surface 34 of a bottle 12 is illustrated in greater detail in FIG. 8. The bottles 12 may move downward in the first vertical lane 26 and the second vertical lane 32 by the force of gravity. Alternatively, controlled downward movement of the bottles 12 can be created by the use of a conveying device such as a moving conveying chain. A plurality of pins are attached to the conveying chain. Each bottle 12 rests on one of the pins attached to the conveying chain. Therefore, the motion of each bottle is controlled by the speed of the moving conveying chain.

A sterilant such as hydrogen peroxide may be provided to the sterilant application apparatus 36 in many ways. For example, liquid hydrogen peroxide may be provided in a reservoir at a level maintained by a pump and overflow pipe. A plurality of measuring cups (e.g., approximately 0.5 ml each) connected by an air cylinder are submerged into the reservoir and are lifted above the liquid level. Thus, a measured volume of liquid hydrogen peroxide is contained in each measuring cup.

Each measuring cup may include a conductivity probe that is configured to send a signal to the control system 550 indicating that the measuring cup is full. A tube (e.g., having a diameter of about 1/16") is positioned in the center of the measuring cup. A first end of the tube is positioned near the bottom of the measuring cup. A second end of the tube is connected to the sterilant application apparatus 36. The sterilant application apparatus 36 includes a venturi and a heated double tube heat exchanger. When the measuring cup is full, and a signal is received from the control system 550, a valve is opened allowing pressurized sterile air to enter the venturi. The pressurized air flow causes a vacuum to be generated in second end of the tube causing liquid hydrogen peroxide to be pulled out of the measuring cup. The liquid hydrogen peroxide is sprayed into a sterile air stream which atomizes the hydrogen peroxide into a spray. The atomized hydrogen peroxide enters the double tube heat exchanger in order to heat the atomized hydrogen peroxide above its vaporization phase. The double tube heat exchanger is heated with steam and the temperature is monitored and controlled by the control system 550. In FIG. 4, the application of the sterilant 14 by the sterilant application apparatus 36 is accomplished through the use of spray nozzles 64 that produce a sterilant fog which is directed to the entire outside surface 34 of each bottle 12.

Alternatively, a direct spray of heated hydrogen peroxide may be continuously applied to the outside surface 34 of each bottle 12. For producing the direct spray, a metering pump regulates the amount of hydrogen peroxide, a flow meter continuously measures and records the quantity of hydrogen peroxide being dispensed, a spray nozzle produces a fine mist, and a heat exchanger heats the hydrogen peroxide above the vaporization point.

FIGS. 3 and 4 illustrate the sterilization chamber 38 for activation and drying of bottles 12 which is included in the bottle infeed, sterilization, and conveying apparatus 60. The sterilization chamber 38 sterilizes the outside surface 34 of each bottle 12. The sterilization chamber 38 encloses a conduit 39. Sterile heated air, which is generated by a sterile air supply system 146 (FIG. 3), enters the conduit 39 of the sterilization chamber 38 through ports 67 and 68 located at the bottom of the sterilization chamber 38. The sterile heated air also enters through a bottom opening 62 of the bottle infeed and sterilization apparatus 60. The sterile heated air travels is up through the conduit 39 of the sterilization chamber 38, and exits the top of the sterilization chamber 38 through an exhaust conduit 70. The sterile heated air continuously flows in an upward direction through the sterilization chamber 38, thus preventing any contaminants from entering the bottle infeed and sterilization apparatus 60. To create the sterile heated air, the air is first passed through a filtering system (e.g., a group of double sterile air filters to sterilize the air. The air is then heated in a heating system (e.g., an electric heater) to about 230° F. The air temperature is regulated by the control system 550. Other techniques for providing the sterile heated air may also be used. The control system 550 monitors the air pressure and flow rate of the sterile heated air to ensure that an adequate flow of the hot sterile air is maintained in the bottle sterilization chamber 38 of the bottle infeed and sterilization apparatus 60.

Figure 6:
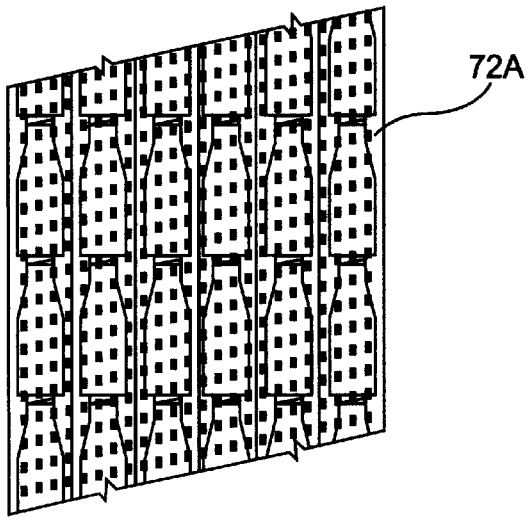
FIG. 6 is an interior sectional view of an interior wall taken along line 6—6 of FIG. 4.
Figure 7:
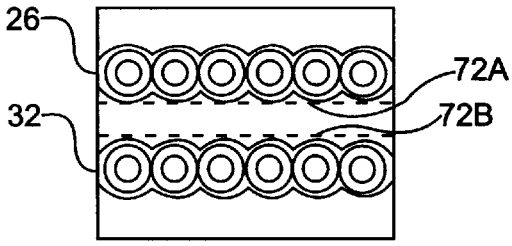
FIG. 7 s a cross-sectional view of the bottle infeed and sterilization apparatus taken along line 7—7 of FIG. 4.

As illustrated in FIGS. 4, 6, and 7, the sterilization chamber 38 includes two opposing, interior, perforated walls 72A, 72B. The perforated walls 72A and 72B guide the bottles 12 downward in the first vertical lane 26 and the second vertical lane 32, respectively. The perforated walls 72A, 72B also allow the complete circulation of hot sterile air around the outside surface 34 of each bottle 12 in the sterilization chamber 38. The sterilization chamber 38 supplies hot sterile air to the outside surface 34 of each bottle 12 between the sterilant application apparatus 36 and the bottom opening 62 of the bottle infeed and sterilization apparatus 60. This sterilant may be hydrogen peroxide or oxonia (hydrogen peroxide and peroxyacetic acid).

In accordance with the preferred embodiment of the present invention, twelve drying positions are provided in the sterilization chamber 38. Each bottle 12 is exposed to the hot sterile air in the sterilization chamber 38 for about at least 24 seconds. This provides time sufficient time for the hydrogen peroxide sterilant to break down into water and oxygen, to kill any bacteria on the bottles 12, and to evaporate from the outside surface 34 of the bottles 12.

An exhaust fan 73 is located at a top of the exhaust conduit 70 to provide an outlet from the sterilization tunnel 90, and to control the sterile air flow rate through the sterilization chamber 38. The exhaust fan 73 is controlled by the control system 550. The control system 550 controls the sterile air temperature preferably to about 230° F., and controls the sterile air flow rate through the sterilization chamber 38. The flow rate is preferably about 1800 scfm through the sterilization chamber 38. The bottles 12 leave the sterilization chamber 38 with a hydrogen peroxide concentration of less than 0.5 PPM.

As shown in FIGS. 3 and 4, a plurality of proximity sensors 71 located along the sides of the vertical lanes 26, 32 detect any bottle 12 jams that occur within the sterilization chamber 38. The proximity sensors 71 transmit an alarm signal to the control system 550. The bottles 12 leave the bottle infeed and sterilization apparatus 60 through the bottom opening 62, and enter a sterilization tunnel 90 of the filler apparatus 50.

Figure 8:
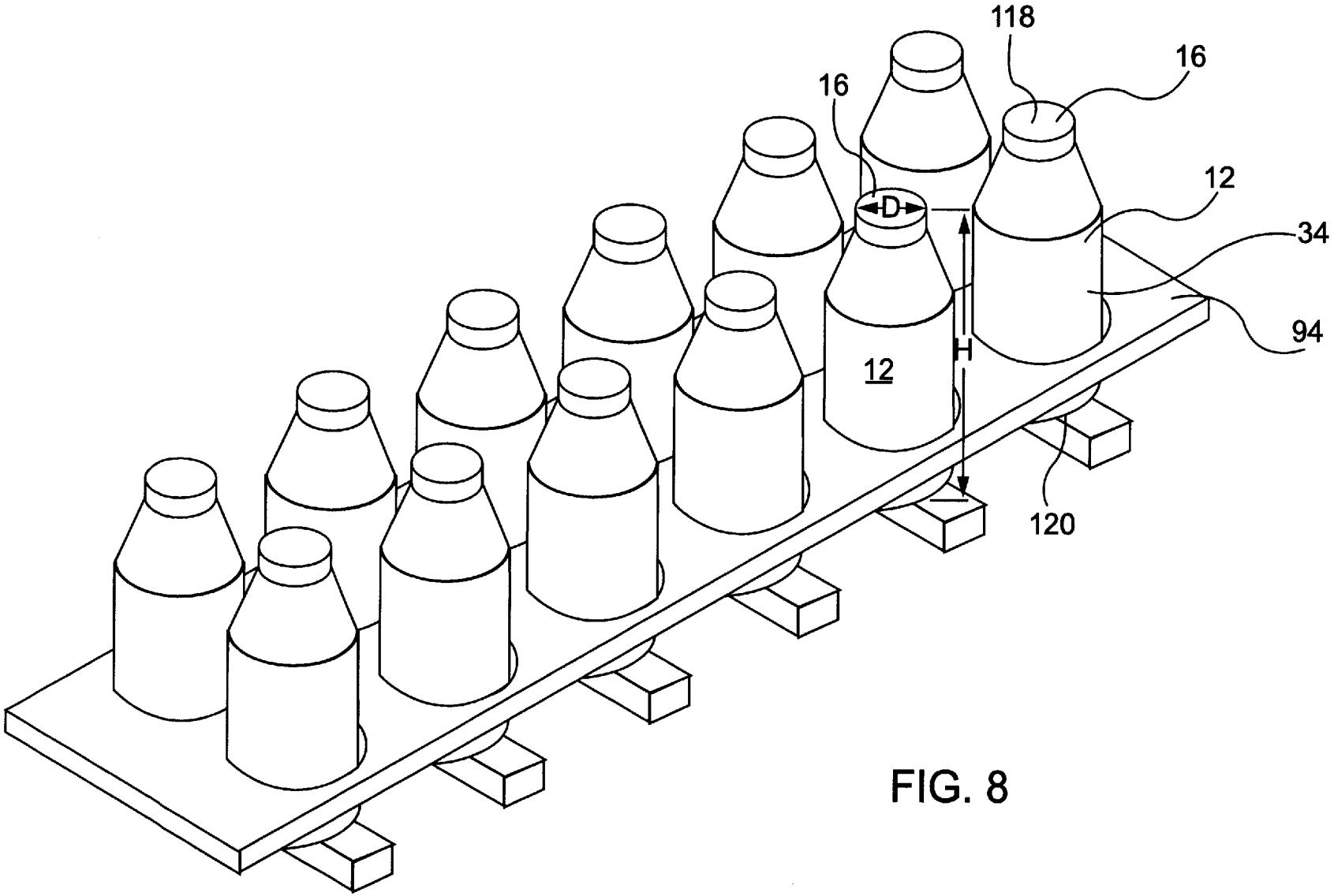
FIG. 8 is a perspective view of a conveying plate for use in the aseptic processing apparatus of the present invention.

In the preferred embodiment of the present invention, the filler apparatus 50 includes forty-one (41) index stations 92, hereafter referred to as "stations." Various index stations 92 are illustrated in FIGS. 3, 4, and 11–15. The conveying motion of the bottles 12 to the various stations 92 through the filler apparatus 50 is based on an indexing motion. The filler apparatus 50 is designed to convey the bottles 12 through the various operations of the filler 50 in a two by six matrix. The twelve bottles 12 in the two by six matrix are positioned in, and displaced by, a conveying plate 94 as illustrated in FIG. 8. Therefore, twelve bottles 12 are exposed to a particular station 92 at the same time. A conveying apparatus 100 moves the set of twelve bottles 12 in each conveying plate 94 sequentially through each station 92.

Referring to FIGS. 3 and 4, the bottles 12 are supplied from an infeed chamber 102 to station 2 of the filler apparatus 50 through the bottom opening 62 of the bottle infeed and sterilization apparatus 60. The infeed chamber 102 is enclosed to direct heated hydrogen peroxide laden air completely around the outer surface 34 of the bottles 12. A mechanical scissors mechanism and a vacuum "pick and place" apparatus 104 position twelve bottles 12 at a time (in a two by six matrix, FIG. 8) into one of the conveying plates 94.

A plurality of conveying plates 94 are attached to a main conveyor 106. The main conveyor 106 forms a continuous element around conveyor pulleys 108 and 110 as illustrated in FIG. 3. A bottle support plate 107 supports a bottom 120 of each bottle 12 as the bottles 12 are conveyed from station to station through the filler apparatus 50. Each conveying plate 94 passes through stations 1 through 41, around pulley 108, and returns around pulley 110 to repeat the process. The main conveyor 106, conveying plates 94, and pulleys 108 and 110 are enclosed in the sterilization tunnel 90.

At station 4, the bottles 12 in the conveying plate 94 enter a bottle detection apparatus 112. The bottle detection apparatus 112 determines whether all twelve bottles 12 are actually present and correctly positioned in the conveying plate 94. Proximity sensors 114 detect the presence and the alignment of each bottle 12. In the present invention, a bottle 12 with correct alignment is in an upright position with the opening 16 of the bottle 12 located in an upward position. Information regarding the location of any misaligned or missing bottles 12 is relayed to the control system 550. The control system 550 uses this location information to ensure that, at future stations 92, bottle filling or sealing will not occur at the locations corresponding to the misaligned or missing bottles 12.

Figure 10:
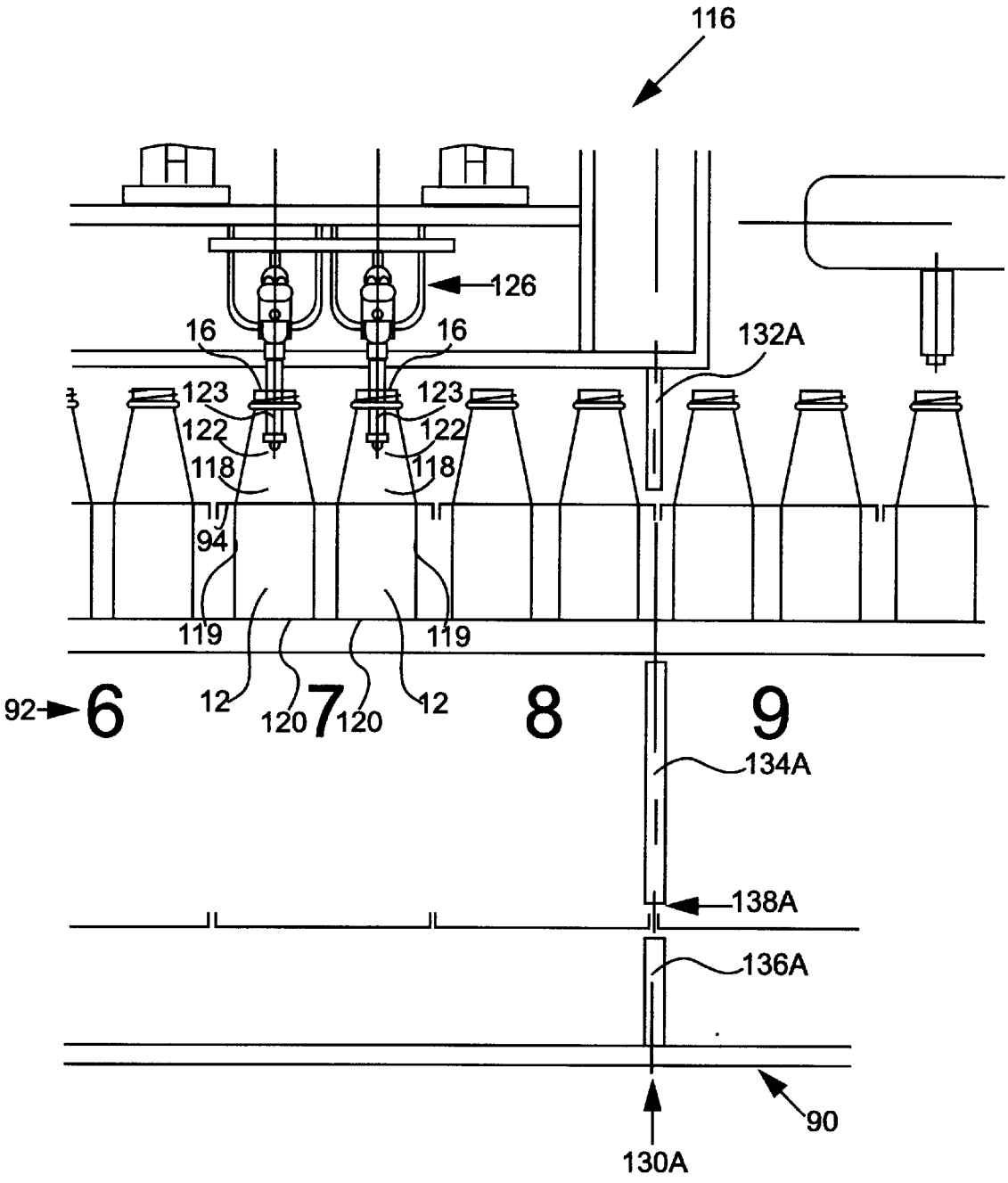
FIG. 10 is a cross-sectional side view of an interior bottle sterilization apparatus and the partition located between stations 8 and 9.
Figure 21:
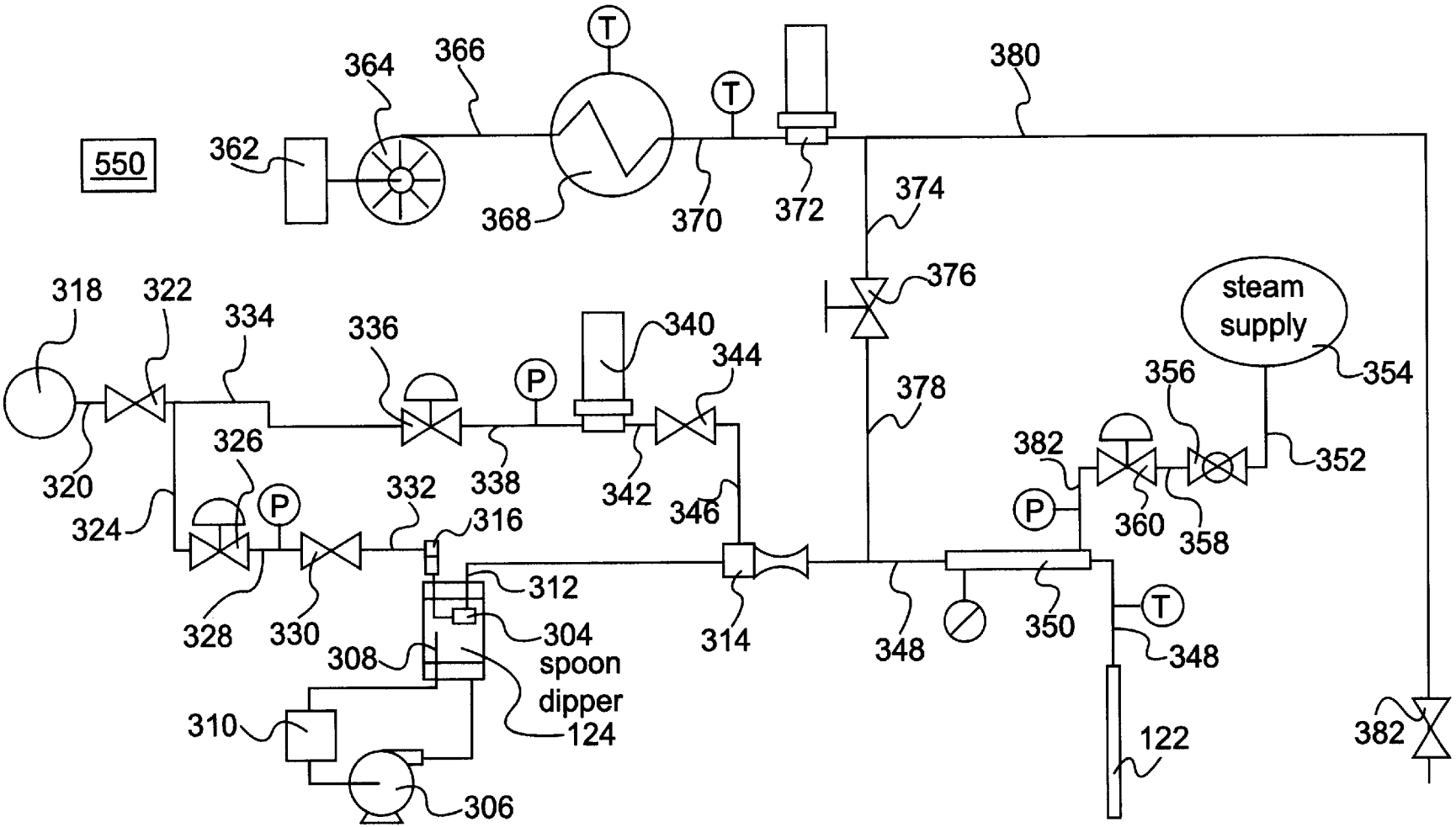
FIG. 21 is a schematic diagram of a sterilization control system for the interior bottle sterilization apparatus.

At station 7, as illustrated in FIGS. 3 and 10, the bottles 12 in the conveying plate 94 enter an interior bottle sterilization apparatus 116. A sterilant, such as hydrogen peroxide, oxonia, or any other suitable aseptic sterilant is applied as a heated vapor fog into the interior 118 of each bottle 12. Preferably, hydrogen peroxide is used as the sterilant in the present invention. The application of sterilant is accomplished with the use of a plurality of sterilant measuring devices 121 and a plurality of probes 123. Each probe 123 includes any practical means for transferring the sterilant from the probe 123 to the interior surface 119 of the bottle 12. For example, an opening or a plurality of openings may be used for ejecting the sterilant onto the interior surface 119. Preferably, in the present invention, an applicator spray nozzle 122 is included in each probe 123. The applicator spray nozzle 122 provides uniform sterilant application without droplet formation on the interior surface 119 of the bottle 12. A separate measuring device 121 and the probe 123 are used for each of the twelve bottle 12 locations in the conveying plate 94. Each sterilant measuring device 121 may include a spoon dipper 304 (e.g., approximately 0.5 ml each) as illustrated in FIG. 21. Each bottle 12 is supplied with the same measured quantity of sterilant, preferably in the form of a hot vapor fog. A pump 306 provides a sterilant (e.g., hydrogen peroxide) from a sterilant supply tank 310 to a reservoir 124. An overflow pipe 308 maintains the sterilant liquid level in the reservoir 124 by returning excess sterilant to the sterilant supply tank 310. The spoon dipper 304 connected to an air cylinder 316 is submerged into the reservoir 124 and is lifted above the liquid level. Thus, a measured volume of liquid hydrogen peroxide (e.g., approximately 0.5 ml) is contained in each spoon dipper 304.

Each spoon dipper 304 may include a conductivity probe that is configured to send a signal to the control system 550 indicating that the spoon dipper 304 is full. A tube 312 (e.g., having a diameter of about 1/16") is positioned in the center of the spoon dipper 304. A first end of the tube 312 is positioned near the bottom of the spoon dipper 304. A second end of the tube 312 is connected to an atomizing venturi 314.

A pressurized air source 318 is connected by a conduit 320 to a flow adjust valve 322. A conduit 324 connects the flow adjust valve 322 to a regulator valve 326. A conduit 328 connects the regulator valve 326 with a solenoid actuated valve 330. A conduit 332 connects the solenoid actuated valve 330 with the air cylinder 316. The control system 550 controls the solenoid actuated valve 330 which controls the compressed air supplied to the air cylinder 316. Compressed air supplied to the air cylinder 316 lowers or lifts the spoon dipper 304 into or out of the liquid sterilant.

A conduit 334 connects the flow adjust valve 322 with the regulator valve 336. A conduit 338 connects the regulator valve 336 with a sterile air filter 340. A conduit 342 connects the sterile air filter 340 with a solenoid actuated valve 344. A conduit 346 connects the solenoid actuated valve 344 with the atomizing venturi 314. When the spoon dipper 304 is full, and a signal is received from the control system 550, the solenoid actuated valve 344 is opened allowing pressurized sterile air to enter the atomizing venturi 314 through the conduit 346. The pressurized air flow causes a vacuum to be generated in the second end of the tube 312 causing liquid hydrogen peroxide to be pulled out of the spoon dipper 304.

A first supply of sterile air is supplied through conduit 346. The pressurized air supplied through conduit 346 is used to atomize the hydrogen peroxide sterilant in the atomizing venturi 314. Atomization of the liquid hydrogen peroxide may be provided by other means such as by using ultrasonic frequencies to atomize the liquid hydrogen peroxide.

A conduit 348 connects with the atomizing venturi 314, passes through a heat exchanger 350 (e.g., double tube heat exchanger), and connects with a probe 123 including the applicator spray nozzle 122. A conduit 352 connects a steam supply 354 with a valve 356. A conduit 358 connects the valve 356 with a regulator valve 360. A conduit 382 connects the regulator valve 360 with the heat exchanger 350.

A second supply of hot sterile air is supplied to the atomized sterilant through a conduit 378. A humidity control apparatus 362 maintains the humidity level of the air entering a blower 364. A conduit 366 connects the blower 364 with a heater 368. A conduit 370 connects the heater 368 with a sterile filter 372. A conduit 374 connects the sterile filter 372 with a flow adjust valve 376. The conduit 378 connects the flow adjust valve 376 with the conduit 348. A conduit 380 connects the sterile filter 372 with a bypass valve 382. The blower 364 operates continuously supplying humidity controlled air to the heater 368. The flow of heated sterile air is controlled with the flow adjust valve 376 and travels through conduit 378.

Exiting conduit 378, the second supply of hot sterile air enters the conduit 348 to mix with the atomized hydrogen peroxide from the atomizing venturi 314. Excess flow of heated sterile air travels through conduit 380 and passes through the bypass valve 382. The second supply of hot sterile air assists in obtaining a uniform concentration of hydrogen peroxide in the air stream in conduit 348 and provides enough momentum to ensure that all portions of the bottle 12 interior 118 are contacted by hydrogen peroxide. Furthermore, the second supply of hot sterile air is continuously blowing, whereas the first supply of sterile air and hydrogen peroxide in conduit 346 is intermittent corresponding to the movement of the bottles 12. Since the second supply of hot sterile air is continuous, hydrogen peroxide does not have the ability to fall out of the air stream and deposit in the delivery conduit 348 in the form of drops. This ensures that the delivery of hydrogen peroxide is consistent from one bottle 12 application to the next and does not allow a drop to be directed into the bottle 12 interior 118.

The mixture of heated sterile air and atomized hydrogen peroxide in conduit 348 passes through the double tube heat exchanger 350. The double tube heat exchanger 350 adds additional heat to the atomized hydrogen peroxide. Heat is supplied to the double tube heat exchanger 350 from the steam supply 354 controlled by the regulator valve 360. Generally, hydrogen peroxide has chemical stabilizers in it that may cause a white powder precipitate to form on the inner surfaces of the double tube heat exchanger 350. This occurs when the temperature differential between the supplied steam heat and the gas to be heated is large. In the present invention, the temperature of the atomized hydrogen peroxide is typically about the same as the supplied steam heat so that a minimal amount of precipitate occurs. Another embodiment of the invention eliminates the need for the double tube heat exchanger 350 because the temperature of the atomized hydrogen peroxide is already at the desired temperature.

The temperature of the atomized gas entering the interior 118 of the bottle 12 is in the range of about 100° C. to 120° C. This temperature is limited to prevent the plastic bottles 12 from melting. The droplet size occurring on the interior surface 119 of the bottles 12 is in the range of about 300 to 500 micrometers. The initial concentration level of hydrogen peroxide on the interior surface 119 of the bottle 12 is about 35%.

As illustrated in FIG. 21, the control system 550 monitors the temperatures at locations denoted as "T" in the interior bottle sterilization apparatus 116. The temperartures "T" are measured in the conduit 348, in the heater 368, and in the conduit 370. Additionally, the control system 550 monitors the pressures at locations denoted as "P" as illustrated in FIG. 21. The pressures "P" are measured in the conduit 328, conduit 338, and in the conduit 382.

The control system 550 monitors and controls a spray apparatus 126 that includes the probe 123 including the applicator spray nozzles 122 FIG. 10. Each applicator spray nozzle 122 sprays the sterilant into the interior 118 of a corresponding bottle 12 as a hot vapor fog. The probe 123 including applicator spray nozzles 122 are designed to extend through the bottle openings 16. The probe 123 including applicator spray nozzles 122 descends into the interior 118 and toward the bottom of the bottles 12. This ensures the complete application of sterilant to the entire interior 118 and interior surface 119 of each bottle 12. Alternately, the probe 123 including the applicator spray nozzles 122 may be positioned immediately above the bottle openings 16 prior to the application of sterilant.

Figure 9:
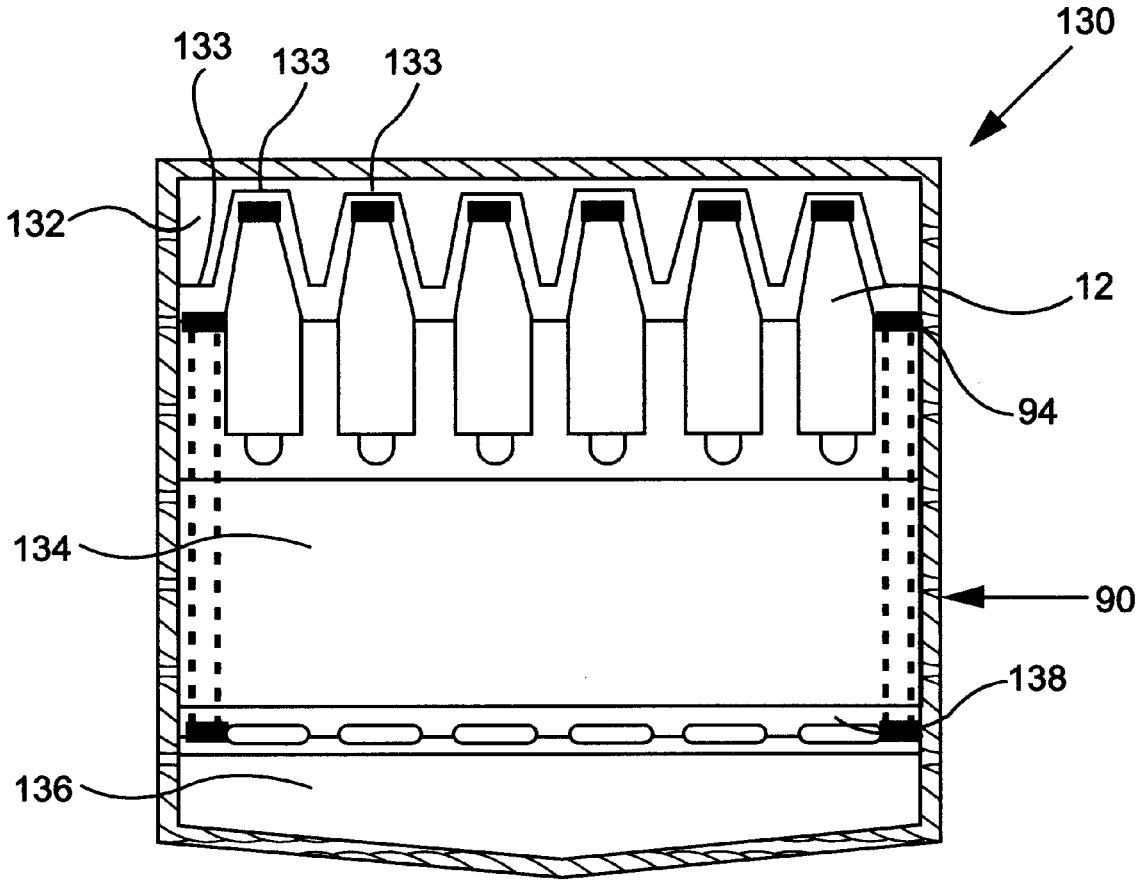
FIG. 9 is a perspective view of a partition in a sterilization tunnel.

FIG. 9 illustrates a perspective view of a partition 130 that provides control of sterile air flow within the sterilization tunnel 90 of the filler apparatus 50. The partition 130 includes a top baffle plate 132, a middle baffle plate 134, and a bottom baffle plate 136. The top baffle plate 132 and the middle baffle plate 134 are provided with cut-outs 133 which correspond to the outer shape of each bottle 12 and to the outer shape of the conveyor plate 94. The cut-outs 133 allow each bottle 12 and each conveyor plate 94 to pass through the partition 130. A space 138 between the middle baffle plate 134 and the bottom baffle plate 136 allows each empty conveyor plate 94 to pass through the partition 130 as it travels on its return trip from the pulley 108 toward the pulley 110.

Figure 11:
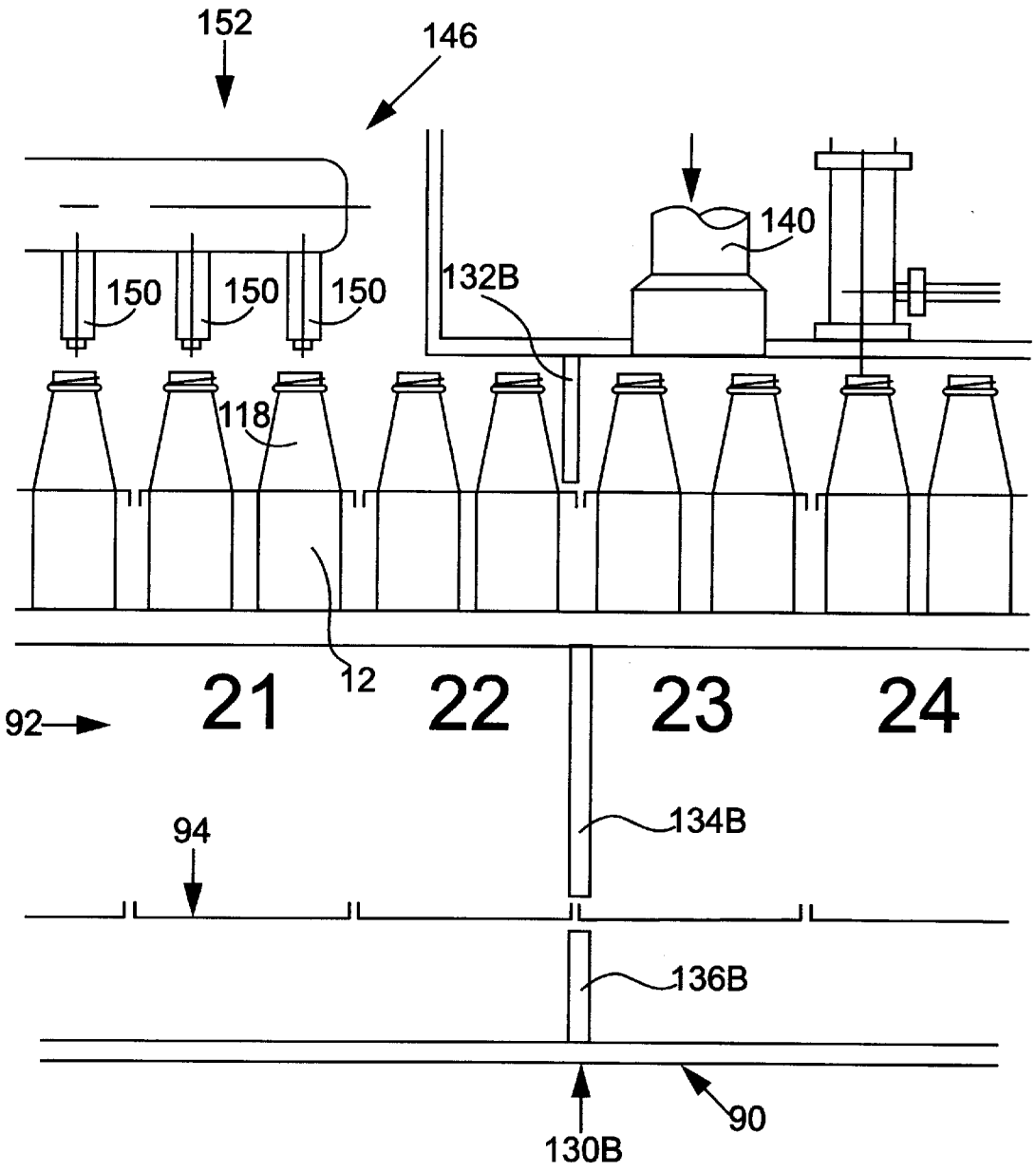
FIG. 11 is a cross-sectional side view of the partition located between stations 22 and 23.
Figure 12:
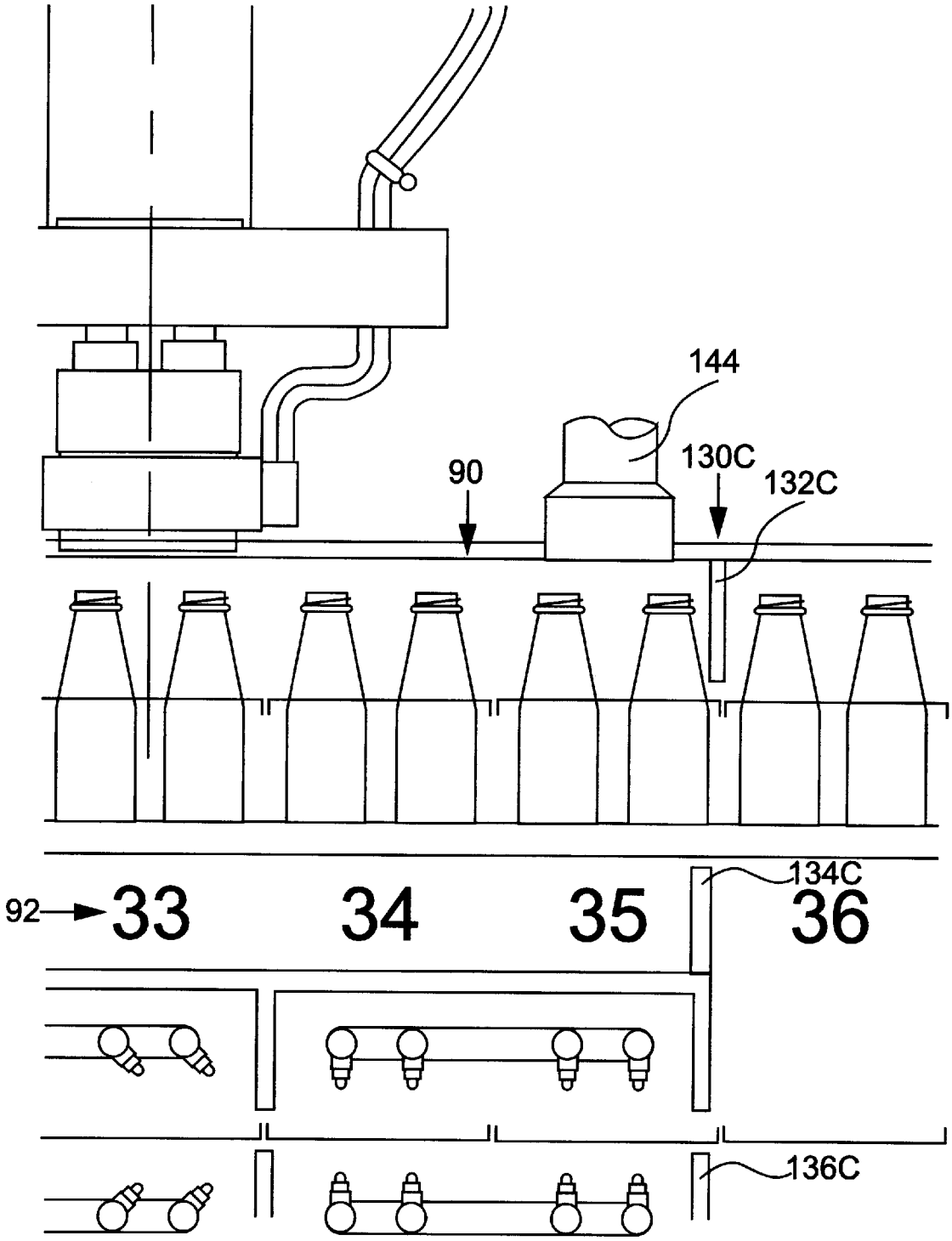
FIG. 12 is a cross-sectional side view of the partition located between stations 35 and 36.

As illustrated in FIG. 3, partitions 130A, 130B, and 130C, are located within the sterilization tunnel 90. FIG. 10 illustrates a cross-sectional view of partition 130A including baffle plates 132A, 134A, and 136A. The partition 130A is located between stations 8 and 9. FIG. 11 illustrates a cross-sectional view of partition 130B including baffle plates 132B, 134B, and 136B. The partition 130B is located between stations 22 and 23. FIG. 12 illustrates a cross-sectional view of partition 130C including baffles 132C, 134C, and 136C. The partition 130C is located between stations 35 and 36. As illustrated in FIG. 3, sterile air is introduced through sterile air supply sources (e.g., conduits 140, 142, and 144) into the sterilization tunnel 90. The sterile air conduit 140 is located at station 23 (FIG. 11), the sterile air conduit 142 is located at station 27 (FIG. 3), and the sterile air conduit 144 is located at station 35 (FIG. 12).

The partition 130A separates an activation and drying apparatus 152 from the interior bottle sterilization apparatus 116. The partition 130B separates the activation and drying apparatus 152 from a main product filler apparatus 160 and a lid sterilization and heat sealing apparatus 162. Thus, a first sterilization zone 164 is created that includes the activation and drying apparatus 152. Partition 130C separates the main product filler apparatus 160 and the lid sterilization and heat sealing apparatus 162 from a bottle discharge apparatus 280. Thus, partitions 130B and 130C create a second sterilization zone 166 that includes the main product filler apparatus 160 and the lid sterilization and heat sealing apparatus 162. A third sterilization zone 172 includes the bottle discharge apparatus 280. A fourth sterilization zone 165 includes the interior bottle sterilization apparatus 116. The second sterilization zone 166 provides a highly sterile area where the bottles 12 are filled with a product and sealed. The second sterilization zone 166 is at a higher pressure than the first sterilization zone 164 and the third sterilization zone 172. Therefore, any gas flow leakage is in the direction from the second sterilization zone 166 out to the first sterilization zone 164 and the third sterilization zone 172. The first sterilization zone 164 is at a higher pressure than the fourth sterilization zone 165. Therefore, gas flow is in the direction from the first sterilization zone 164 to the fourth sterilization zone 165.

The partitions 130A, 130B, and 130C create sterilization zones 164, 165, 166, and 172 with different concentration levels of gas laden sterilant (e.g., hydrogen peroxide in air). The highest concentration level of sterilant is in the fourth sterilization zone 165. For example, with the sterilant hydrogen peroxide, the concentration level of hydrogen peroxide is about 1000 ppm (parts per million) in the fourth sterilization zone 165. The hydrogen peroxide sterilant level is about 3 ppm in the first sterilization zone 164. The lowest concentration level of sterilant is in the second sterilization zone 166. In the second sterilization zone 166, the hydrogen peroxide sterilant concentration level is less than .5ppm and typically about 0.1 ppm. Advantageously, this helps to maintain the main product filler apparatus 160 and the lid sterilization and heat sealing apparatus 162 at a low sterilant concentration level. This prevents unwanted high levels of sterilant to enter the food product during the filling and lidding process. The hydrogen peroxide sterilant concentration level is about 0.1 ppm in the third sterilization zone 172.

Figure 14:
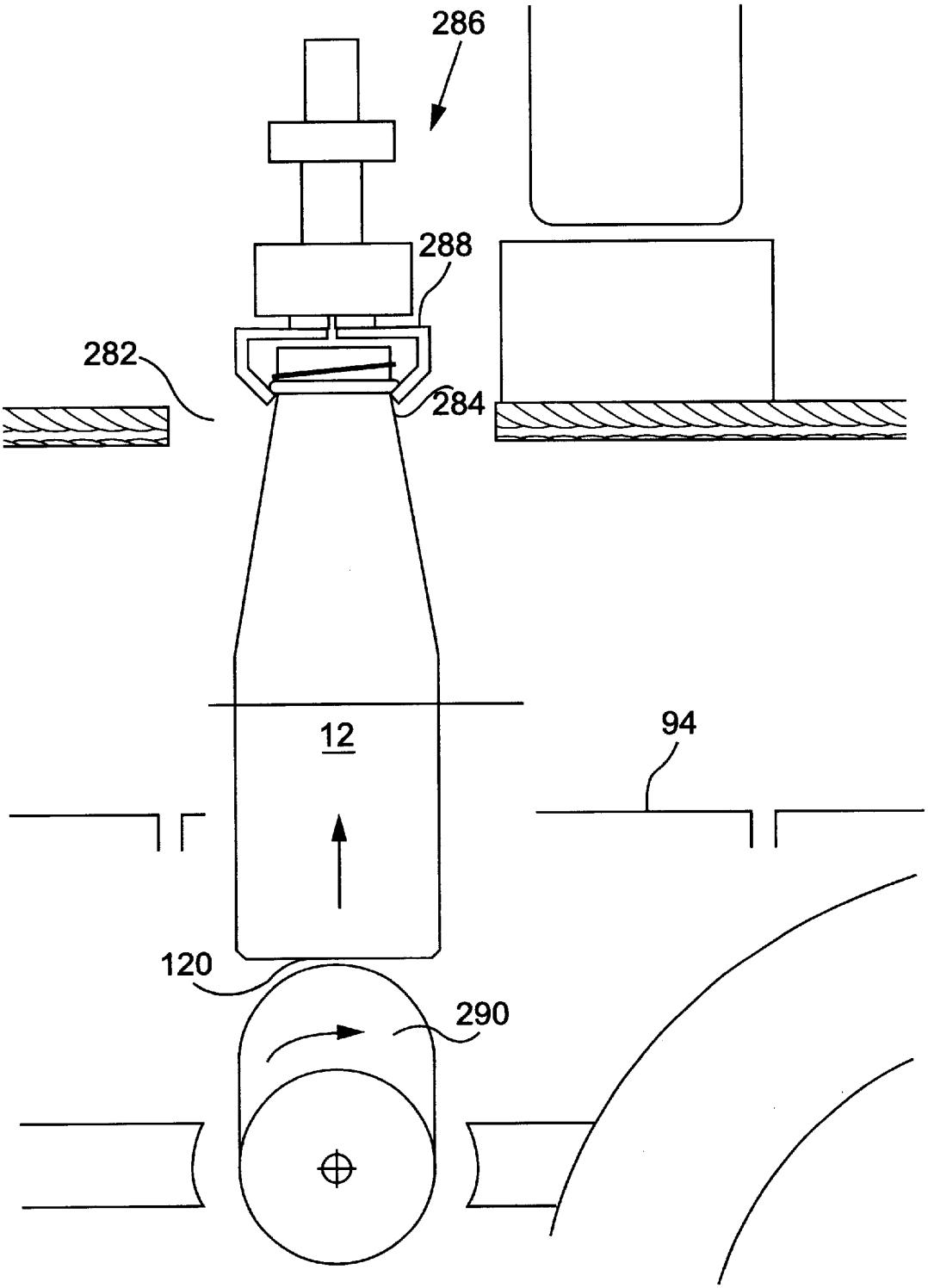
FIG. 14 is a side view of a lifting apparatus with a gripper mechanism for lifting the bottles from the sterilization tunnel.
Figure 15:
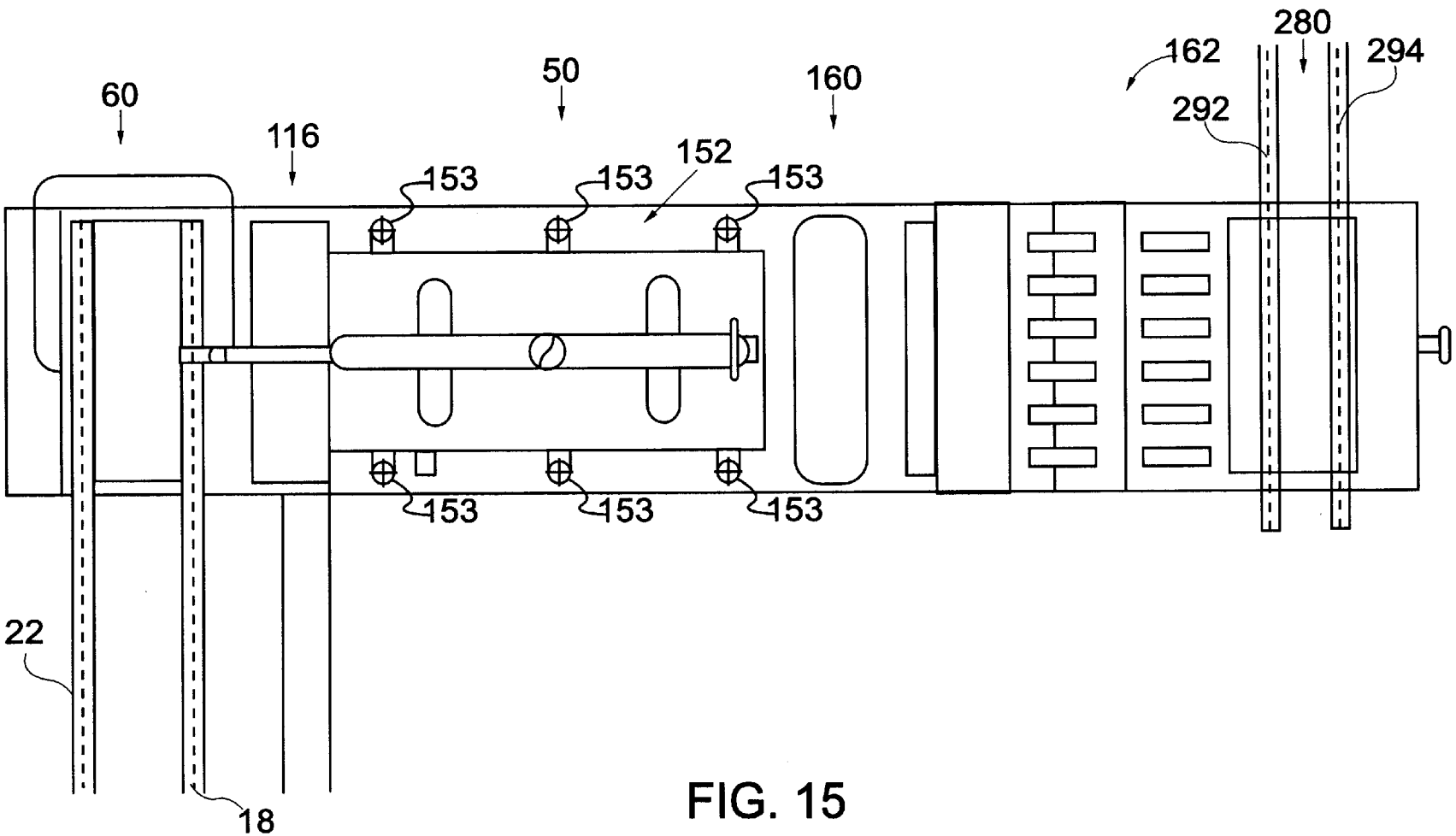
FIG. 15 is a top view of the aseptic processing apparatus.

As illustrated in FIG. 3, a gas such as hot sterile air enters the first sterilization zone 164 at a rate of about 2400 cfm (cubic feet per minute). The temperature of the hot sterile air is about 230° F. The hot sterile air enters the first sterilization zone 164 through conduit 148. Additional hot sterile air enters the second sterile zone through sterile air conduits 140, 142, and 144 at a total rate of about 1000 cfm (FIG. 3). Also, hot sterile air enters at a rate of about 1800 cfm through ports 67 and 68 leading into the infeed and sterilization apparatus 60. A portion of the hot sterile air exits the sterilization tunnel 90 at a rate of about 1500 cfm through a plurality of exhaust ports 153 located in the first sterilization zone 164 (FIG. 15). A portion of the hot sterile air exits the sterilization tunnel 90 at a rate about 100 cfm through an opening 282 (FIG. 14). The bottles 12 exit the sterilization tunnel 90 through the opening 282. The continuous flow of sterile air flow out through the opening 282 prevents contaminants from entering the sterilization tunnel 90.

As illustrated in FIG. 3, the hot sterile air is drawn out of the fourth sterilization zone 165 of the sterilization tunnel 90 through the bottom opening 62 in the bottle infeed and sterilization apparatus 60. Next, the hot sterile air from the infeed and sterilization apparatus together with the fourth sterilization zone 165 exits out of the exhaust conduit 70 of the infeed and sterilization apparatus at a rate of about 3600 cfm. This outflow of hot sterile air from the bottle infeed and sterilization apparatus 60 prevents contaminants from entering the bottle infeed sterilization apparatus 60 and the sterilization tunnel 90.

Stations 10 through 21 include twelve stations for directing hot sterile air into each bottle 12 for the activation and removal of the sterilant from the interior of the bottle 12. In these twelve stations, a third supply of hot sterile air is provided through the sterile air supply system 146. The sterile air supply system 146 supplies hot sterile air to a plurality of nozzles 150 in the activation and drying apparatus 152. The hot sterile air flow in each bottle 12 is about 40 SCFM. Hot sterile air is supplied to the sterile air supply system 146 through conduit 148. The air is first passed through a filtration system to sterilize the air. The air is then heated in a heating system to about 230° F. The air temperature is regulated by the control system 550. Also, the control system 550 monitors the air pressure and flow rate to ensure that an adequate flow of hot sterile air is maintained in the sterilization tunnel 90 of the application and drying apparatus 152.

As shown in FIG. 8, each bottle 12 generally has a small opening 16 compared to its height "H." A ratio of a diameter "D" of the bottle 12 to the height "H" of the bottle 12 is generally less than 1.0. The small bottle opening 16 combined with a larger height "H" restricts the flow of hot gas into the interior 118 of the bottle 12. Also, PET and HDPE bottle materials have low heat resistance temperatures. These temperatures commonly are about 55° C. for PET and about 121° C. for HDPE. Typically, in the aseptic packaging industry, a low volume of air at a high temperature is applied to the packaging materials. This often results in deformation and softening of packaging materials formed of PET and HDPE. In order to prevent softening and deformation of the bottles 12, when formed from these types of materials, the present invention applies high volumes of air at relatively low temperatures over an extended period of time in the activation and drying apparatus 152. The plurality of nozzles 150 of the activation and drying apparatus 152 direct hot sterile air into the interior 118 of each bottle 12 (FIG. 11). A long exposure time is predicated by the geometry of the bottle 12 and the softening temperature of the material used to form the bottle 12. In the present invention, about 24 seconds are allowed for directing hot sterile air from the plurality of nozzles 150 into each bottle for the activation and removal of sterilant from the interior surface 119 of the bottle 12. To achieve aseptic sterilization, a minimum bottle temperature of about 131° F. should be held for at least 5 seconds. To achieve this bottle temperature and time requirements, including the time required to heat the bottle, the sterilant is applied for about 1 second and the hot sterile air is introduced for about 24 seconds. The hot sterile air leaves the nozzles 150 at about 230° F. and cools to about 131° F. when it enters the bottle 12. The hot sterile air is delivered at a high volume so that the bottle 12 is maintained at about 131° F. for at least 5 seconds. The about 24 seconds provides adequate time for the bottle 12 to heat up to about 131° F. and to maintain this temperature for at least 5 seconds. After bottle 12 has dried, the residual hydrogen peroxide remaining on the bottle 12 surface is less than 0.5 PPM.

A foodstuff product is first sterilized to eliminate bacteria in the product. An "Ultra High Temperature" (UHT) pasteurization process is required to meet the aseptic FDA standard. The time and temperature required to meet the aseptic FDA standard depends on the type of foodstuff. For example, milk must be heated to 282° F. for not less than 2 seconds in order to meet the aseptic standards.

Figure 13:
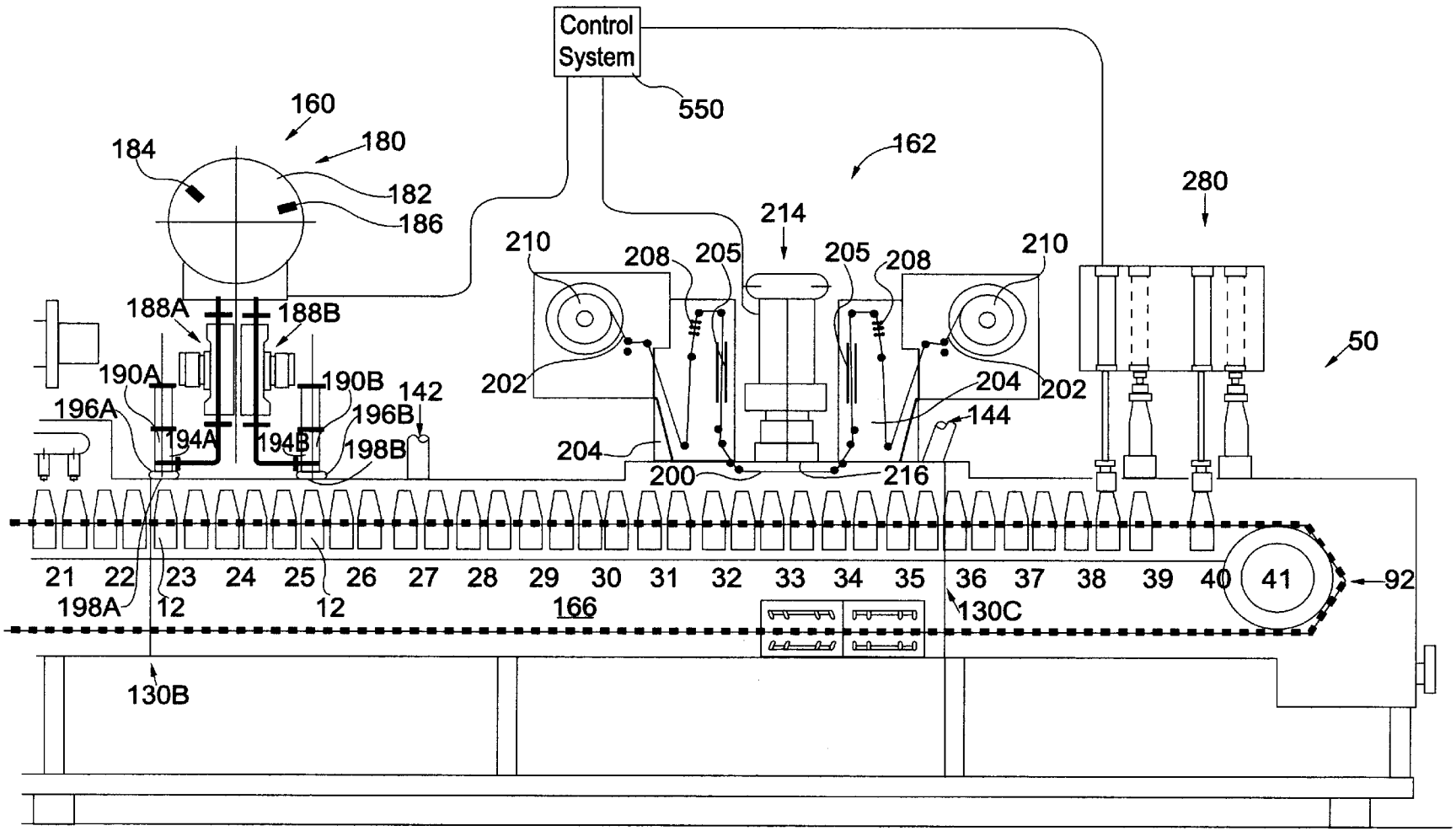
FIG. 13 is a cross-sectional side view of a lid sterilization and heat sealing apparatus.
Figure 22:
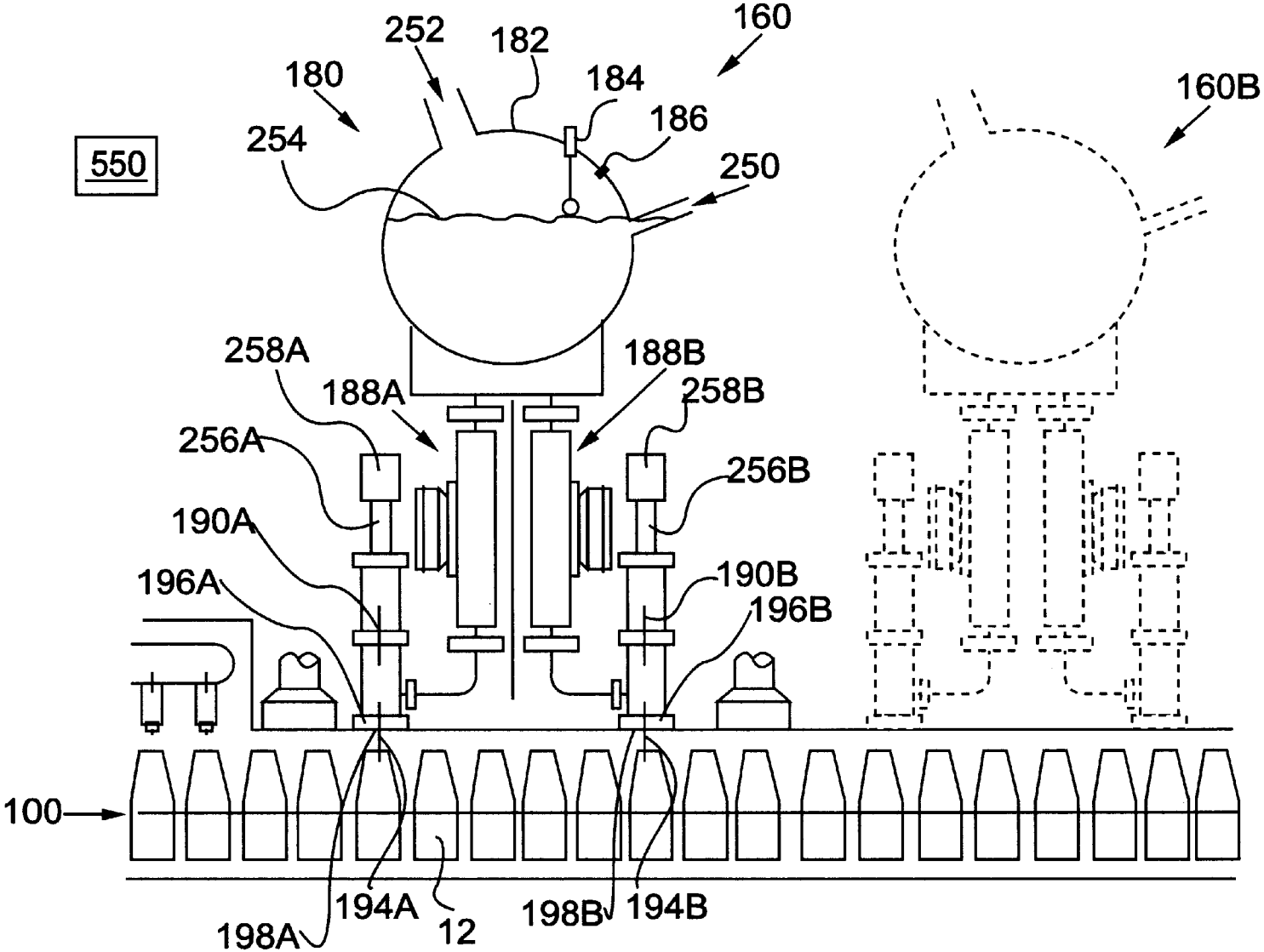
FIG. 22 is a side view of a main product filler apparatus.

After UHT pasteurization, the product is delivered to a main product filler apparatus 160. The main product filler apparatus is illustrated in FIGS. 3, 13, and 22. The main product filler 160 can be sterilized and cleaned in place to maintain aseptic FDA and 3A standards. A pressurized reservoir apparatus 180 that can be steam sterilized is included in the main product filler apparatus 160. As illustrated in FIG. 22, the pressurized reservoir apparatus 180 includes an enclosed product tank 182 with a large capacity (e.g., 15 gallons). The product tank 182 is able to withstand elevated pressures of about 60 psig or more. The pressurized reservoir apparatus 180 also includes a level sensor 184, a pressure sensor 186, at least one volumetric measuring device 188 (two are shown as 188A, 188B), and at least one filling nozzle 190 (two are shown as 190A, 190B). The product tank 182 includes a single product inlet 250 with a valve cluster (not shown) including a sterile barrier to separate the product supply system (not shown) from the main product filler apparatus 160. The product tank 182 has an outlet with twelve connections. At each connections is a volumetric measuring device 188 such as a mass or volumetric flow meter. Pressurized steam or sterile air is supplied into the product tank 182 through the inlet 252. The product level 254 in the product tank 182 is measured by the level sensor 184. The control system 550 maintains the product level and pressure in the product tank 182. This supplies each filling nozzle 190 (e.g. 190A, 190B) with a constant pressure that ensures proper product delivery to the bottles 12.

Filling nozzles 190A, 190B are provided at stations 23, 25, respectively. Additionally, there are a plurality of corresponding volumetric measuring devices 188A and 188B to measure the volume of product entering each bottle 12 at stations 23 and 25, respectively. In accordance with the present invention, the volumetric measuring devices 188A and 188B are preferably electronic measuring devices such as a magnetic flow meter which measures the volume of product flow, or a mass flow meter which measures the weight of product flow. The electronic measuring devices provide filling accuracies of about 0.5%. The control system 550 calculates the desired volume of product to be inserted into each bottle 12, and controls the product volume by opening or closing a plurality of valves 194A and 194B included in the filling nozzles 190A and 190B, respectively. The amount of product delivered to the bottles 12 is controlled by the duration of time that the plurality of valves 194A and 194B are open. The control system 550 controls the duration of time. Thus, any desired quantity of product may be selected by controlling the duration of time that the valves 194A and 194B are open.

A first embodiment of activation mechanisms 402A and 402B for valves 194A and 194B include valve stems 256A and 256B attached to actuators 258A and 258B, respectively (FIG. 22). Each actuator 258A, 258B may include any suitable actuating apparatus (e.g. hydraulic, pneumatic, electrical, etc.). Preferably, in the present invention, the actuators 258A and 258B include air cylinders controlled by the control system 550. The actuators 258A and 258B are attached to the valve stems 256A and 256B, respectively. The actuators 258A and 258B displace the valve stems 256A and 256B in an upward and downward direction.

Figure 23:
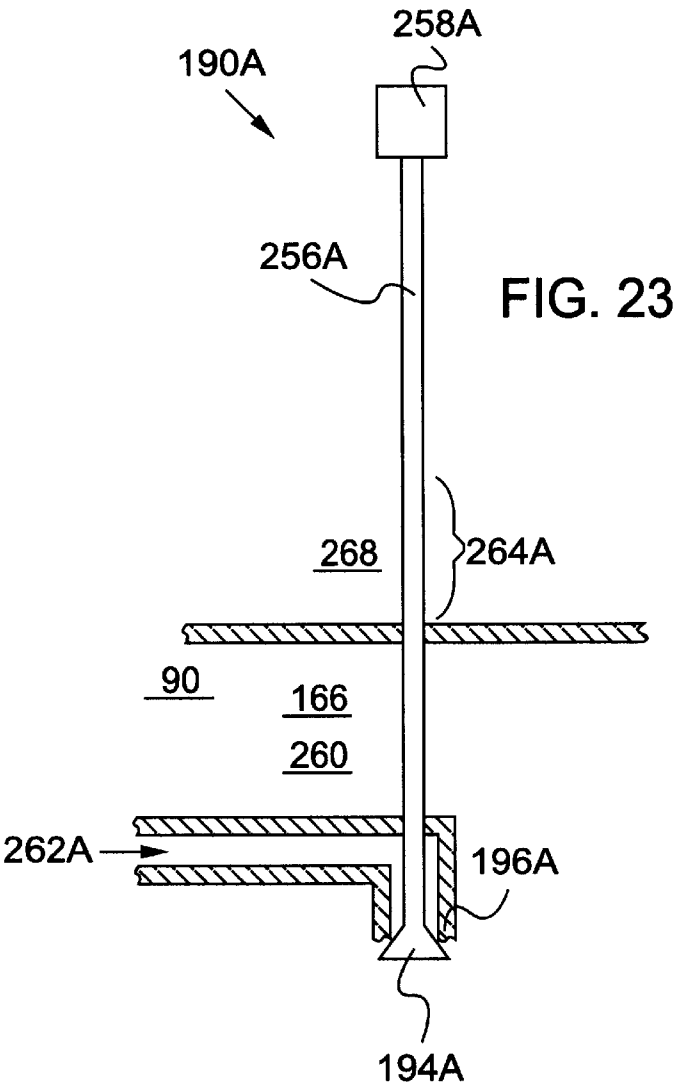
FIG. 23 is a cross-sectional view of a first embodiment of an activation mechanism including a valve in a closed position in a first sterile region.

FIG. 23 illustrates the valve stem 256A attached to the valve 194A. A first sterile region 260 surrounds the nozzle 196A through which product 262A exits. The first sterile region 260 is connected to, and is at the same sterilization level as, the second sterilization zone 166 (FIG. 3) of the sterile tunnel 90. The valve 194A is in a closed position against nozzle 196A blocking the flow of product 262A into a bottle 12 (not shown) located in the first sterile region 260. A first portion 264A of the valve stem 256A is surrounded by a non-sterile region 268, for example, the area located outside of the sterile tunnel 90. Thus, the first portion 264A of the valve stem 256A is exposed with contaminants.

Figure 24:
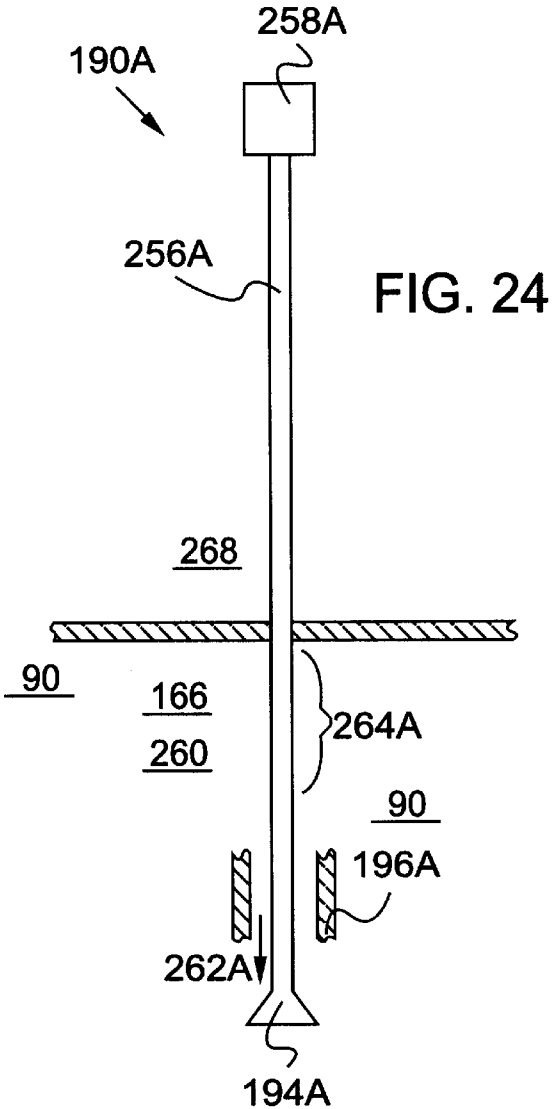
FIG. 24 is a cross-sectional view with a portion of a valve stem displaced from a non-sterile region into the first sterile region.
Figure 25:
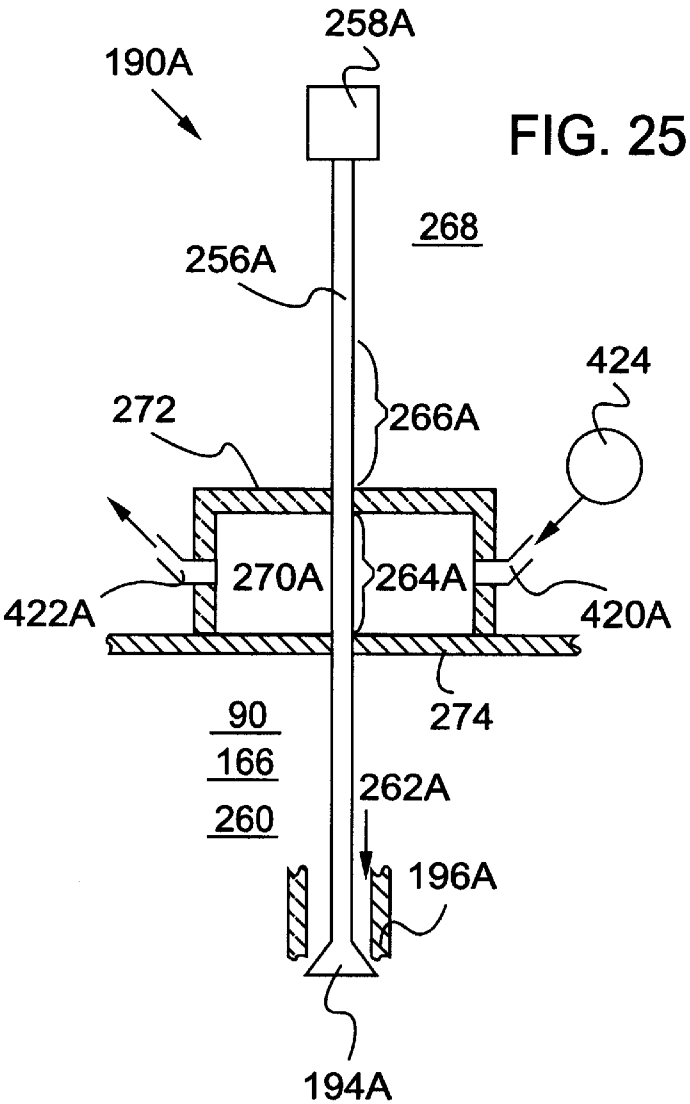
FIG. 25 is a cross-sectional view of the valve in a closed position in a first sterile region, and with the portion of the valve stem located in a second sterile region.

As illustrated in FIG. 24, the actuator 258A has displaced the valve stem 256A in a downward direction. The valve 194A is removed from the nozzle 196A allowing product 262A to flow into a bottle 12 (not shown). The first portion 264A of the valve stem 256A has entered the first sterile region 260. This may create a problem because the first portion 264A of the valve stem 256A may carry contaminants from the non-sterile region 268 into the first sterile region 260. In order to overcome this difficulty, the present invention has introduced a second sterile region 270 as illustrated in FIG. 25.

The second sterile region 270A is enclosed by a housing 272 and by a wall 274. The wall 274 separates the second sterile region 270A from the first sterile region 260. The first sterile region 260 is connected to, and is at the same sterilization level, as the second sterilization zone 166 of the sterile tunnel 90. A sterilizing media 424 is supplied to the second sterile region 270A through the inlet conduit 420A. An outlet conduit 422A may be added to allow the sterilizing media 424 to leave the second sterile region 270A. The sterilizing media 424 may include any suitable sterilant (e.g. steam, hydrogen peroxide, oxonia, etc.). The non-sterile region 268 lies outside of the housing 272. A second portion 266A of the valve stem lies in the nonsterile region 268. As illustrated in FIG. 25, the valve 194A is in a closed position against the nozzle 196A blocking the flow of product 262A into a bottle 12 (not shown) in the first sterile region 260. The first portion 264A of the valve stem 256A is surrounded by the second sterile region 270A. Thus, the first portion 266A of the valve stem 256A is maintained in a sterile condition.

Figure 26:
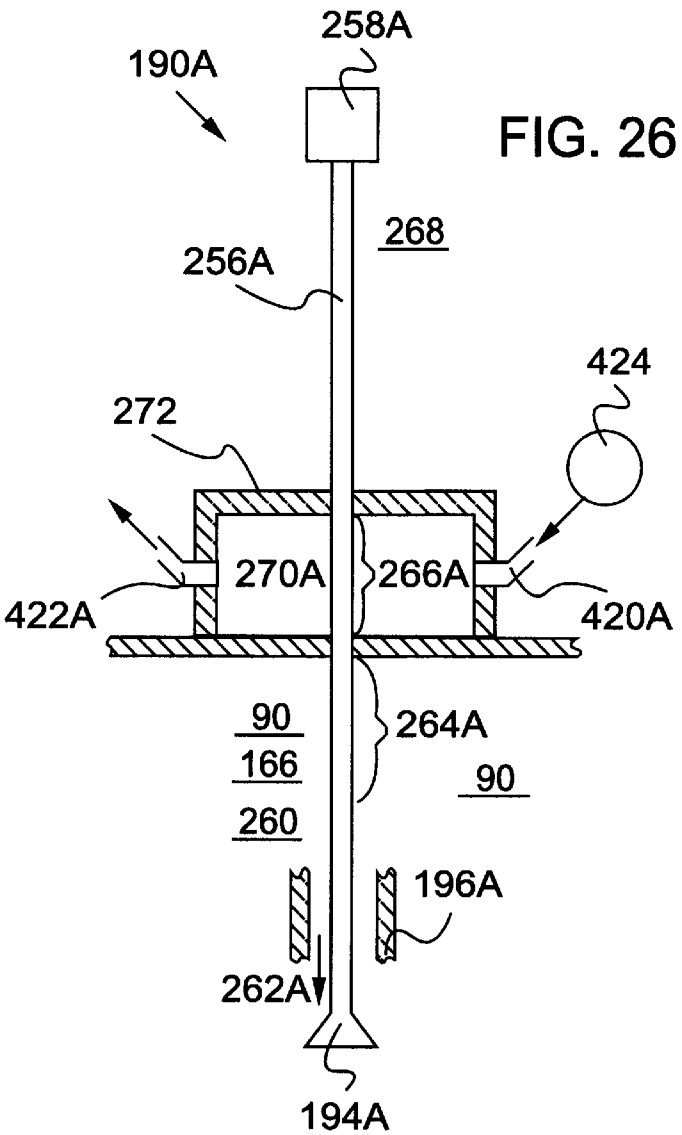
FIG. 26 is a cross-sectional view of the valve in an open position where the portion of the valve located in the second sterile region has been displaced into the first sterile region.

As illustrated in FIG. 26, the actuator 258A has displaced the valve stem 256A in a downward direction. The valve 194A is removed from the nozzle 196A allowing product 262A to flow into a bottle 12 (not shown). The first portion 264A of the valve stem 256A has entered the first sterile region 260. In the present invention, the first portion 264A of the valve stem 256A has not introduced contaminants into the first sterile region 260 because the first portion 264A of the valve stem 256A was pre-sterilized in the second sterile region 270A before entering the first sterile region 260. The second portion 266A of the valve stem 256A has entered the second sterile region 270A from the non-sterile region 268. The second portion 266A of the valve stem 256A is sterilized in the second sterile region 270A removing any contaminants. Therefore, the second sterile region 270A removes any contaminants from the valve stem 256A before any portion of the valve stem 256A enters the first sterile region 260. Thus, contaminants are prevented from entering the sterile tunnel 90 through the filling nozzles 190A and 190B, and the valves 194A and 194B, respectively.

The plurality of valves 194A control the volume of product flowing through a corresponding plurality of nozzles 196A into the bottles 12 at station 23. The plurality of valves 194B control the volume of product flowing through a corresponding plurality of nozzles 196B into the bottles 12 at station 25. The control system 550 uses previously stored information provided by the bottle detection apparatus 112 to only allow filling to occur at the locations where bottles 12 are actually present and correctly aligned.

The initial sterilization process for the first embodiment of the activation mechanisms 402A, 402B, and the pressurized reservoir apparatus 180 includes the step of exposing all of the surfaces of the pressurized reservoir apparatus 180 that come in contact with the product to steam at temperatures above about 250° F. for a minimum of about 30 minutes. Elements such as cups 198A and 198B (FIG. 22) are used to block off nozzle outlets 196A and 196B, respectively, to allow a build-up of steam pressure to about 50 psig inside the pressurized reservoir apparatus 180. Condensate generated as the steam heats the interior surfaces of the pressurized reservoir apparatus 180 is collected in the cups 198A and 198B. This condensate is released when the cups 198A and 198B are removed from the nozzle outlets 196A and 196B. Once the interior surfaces of the pressurized reservoir apparatus 180 are sterilized, the steam is shut off, and sterile air is used to replace the steam. The sterile air reduces the interior temperature of the pressurized reservoir apparatus 180 to the temperature of the product before the product is allowed to enter the enclosed product tank 182. As shown in FIG. 13, sterile air is directed through sterile air conduits 142 and 144 into the second sterilization zone 166 at a volume rate of about 800 scfm. The sterile air flow entering the second sterilization zone 166 provides sterile air to the main product filler apparatus 160 and to the lid sterilization and heat sealing apparatus 162.

The main product filler apparatus 160 includes a separate filling position for each bottle. A bottle 12 moves into position under a nozzle 196. The bottle stops and the valve 194 opens allowing product 262 to enter the bottle 12. The volumetric measuring device 188 measure the amount of product entering the bottle 12. Next, when the desired bottle 12 fill level is achieved, the valve 194 is closed. The control system 550 controls the valve opening and closing. Additionally, the control system 550 does not allow product 262 to flow if a bottle 12 is not present. The bottle 12 filling operation is completed for six bottles at station 23 and for six bottles at station 25. The filling cycle is repeated for each cycle of the aseptic processing apparatus 10. In the present invention the bottle filling time is about 1.5 seconds. Another embodiment of the present invention adds a second main product filler apparatus 160B located at, for example, stations 27 and 29 (FIG. 22). In this embodiment, the bottles 12 are partially filled by the first main product filler apparatus 160 at stations 23 and 25. Next, the bottles are moved to the second main product filler apparatus 160B where the filling of each bottle is completed at stations 27 and 29. For example, in filling each 16 fluid ounce bottle 12, the first main product filler apparatus 160 would fill the first 8 ounces in about 1.5 seconds. Next, the second main product filler apparatus 160 would fill the remaining 8 ounces in each bottle 12 in another about 1.5 seconds. The second main product filler 160B allows the operation to be kept to about 1.5 seconds at each main product filler apparatus 160, 160B. This allows the conveying apparatus 100 to move the bottles through the aseptic processing apparatus 10 at speeds greater than about 350 bottles 12 per minute.

Figure 27:
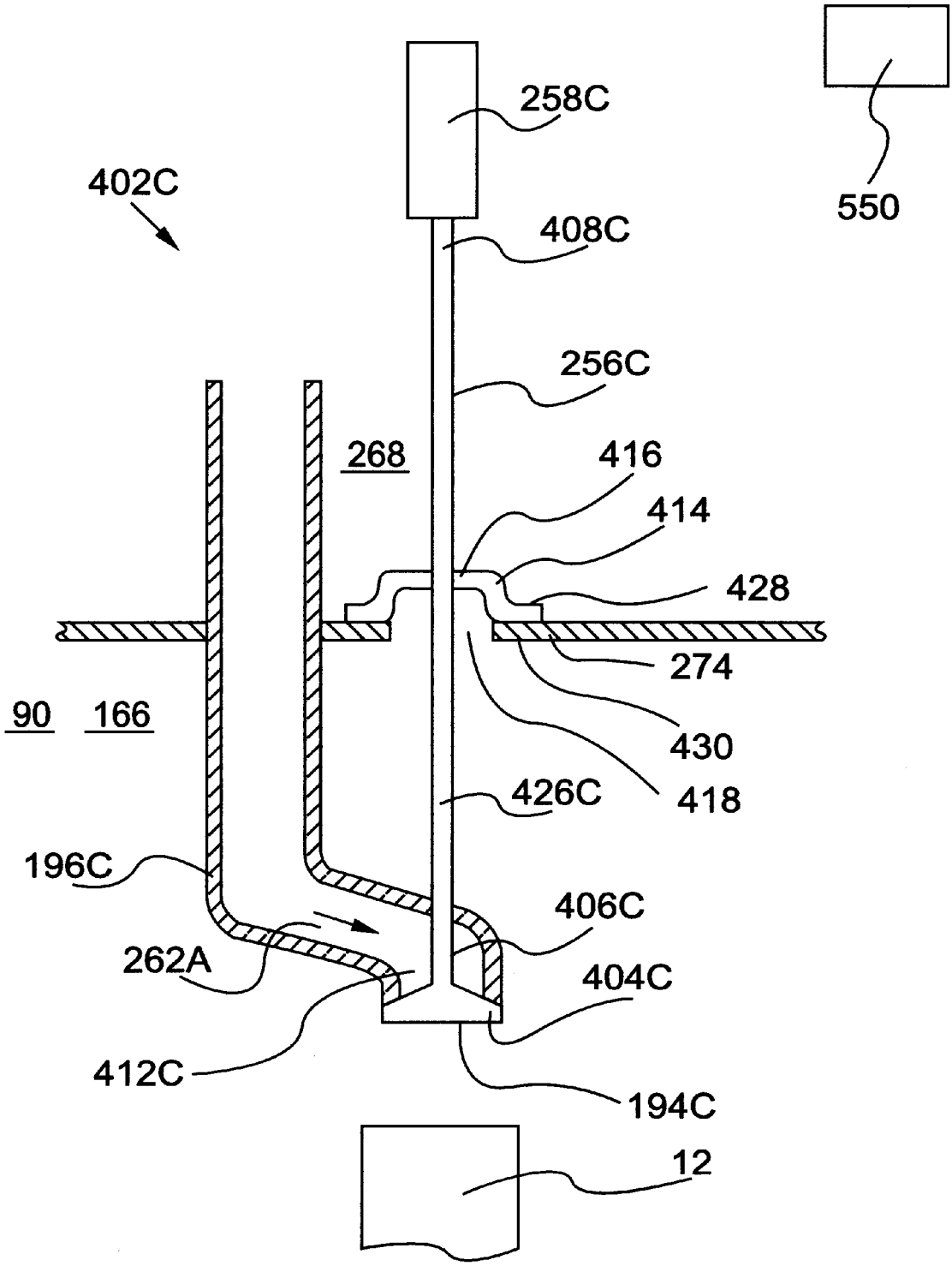
FIG. 27 is a cross-sectional view of a second embodiment of an activation mechanism including a valve in a closed position with a flexible diaphragm attached to a valve stem and to a wall off the sterile tunnel.

A second embodiment of an activation mechanism 402C is illustrated in FIG. 27. The activation mechanism for valve 194C includes a valve stem 256C attached to an actuator 258C. The actuator 258C may include any suitable actuating means (e.g., hydraulic, pneumatic, electrical, etc.). In the present example, the actuator 258C includes an air cylinder controlled by the control system 550. The valve 194C includes a valve head 404C. The valve head 404C is attached to a first end 406C of the valve stem 256C. The actuator 258C is attached to a second end 408C of the valve stem 256C. The actuator 258C displaces the valve stem 256C in an upward and downward direction.

As illustrated in FIG. 27, the second sterilization zone 166 of the sterile tunnel 90 (FIG. 3) surrounds a nozzle 196C and an outlet port 412C of the nozzle 196C through which the product 262A exits. The valve head 404C opens and closes the outlet port 412C of the nozzle 196C. The valve stem 256C passes through an opening 418 in the wall 274 of the sterile tunnel 90. A central portion 416 of a flexible diaphragm 414 is attached to the valve stem 256C. A peripheral portion 428 of the flexible diaphragm 414 is attached to a peripheral region 430 surrounding the opening 418 in the wall 274 of the sterile tunnel 90. The flexible diaphragm 414 may be any suitable material used for containing an aseptic food product (e.g., "EPDM" ethylene-propylene-dieneterpolymers, "Teflon™" polytetrafluoroethylene, "Viton™" fluoroelastomer, etc.). The flexible diaphragm 414 prevents contaminants from traveling from the non-sterile region 268 to the second sterilization zone 166 of the sterile tunnel 90. The lower portion 426C of the valve stem 256C remains in the second sterilization zone 166 as the valve stem 256C moves in an upward and downward direction.

FIG. 27 illustrates the valve 194C in a closed position with the valve head 404C closing the outlet port 412C of the nozzle 196C. Thus, the valve head 404C of the valve 194C blocks the flow of product 262A into the bottle 12. The bottle 12 is located in the second sterilization zone 166.

Figure 28:
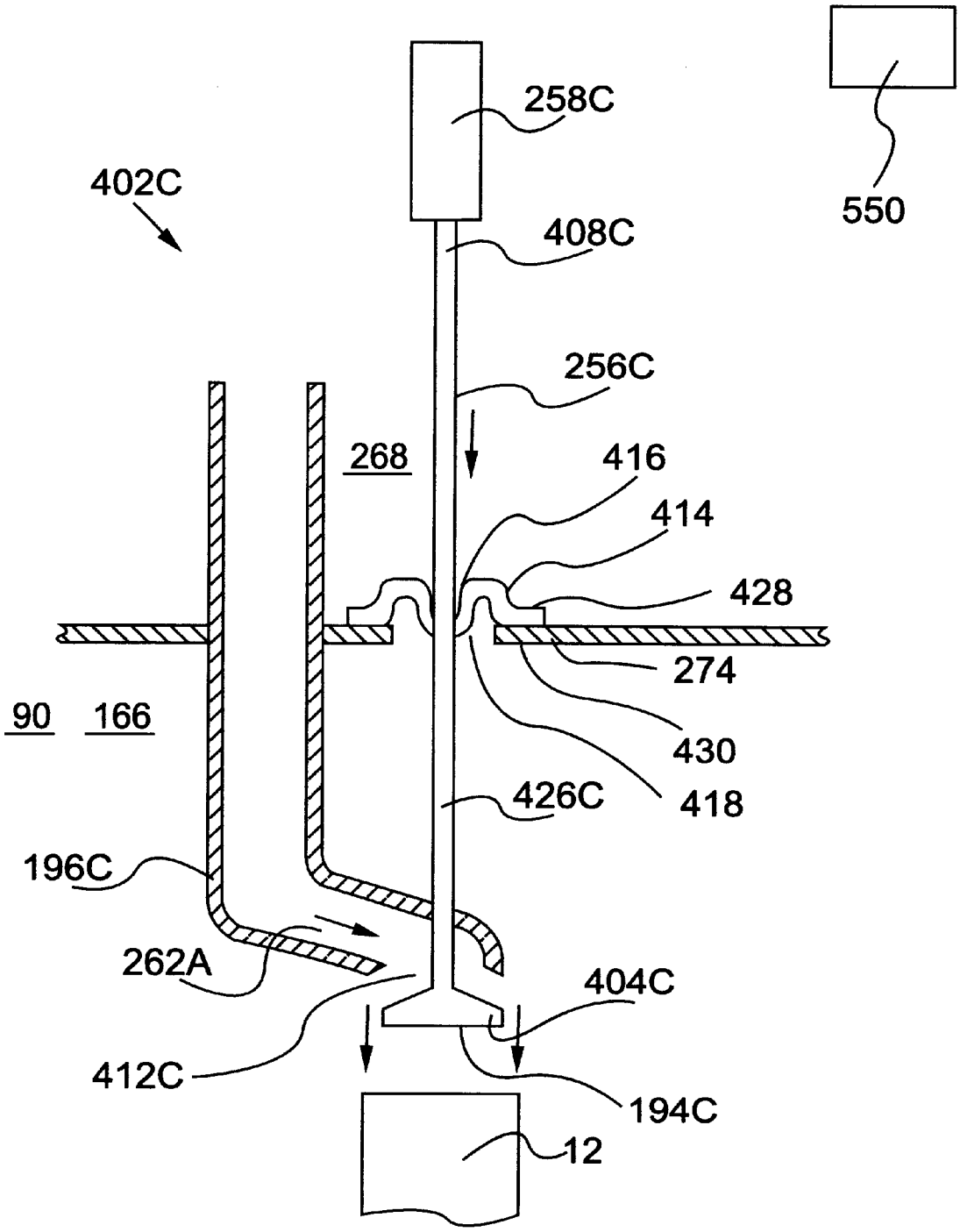
FIG. 28 is a cross-sectional view of the valve of FIG. 27 in an open position.

As illustrated in FIG. 28, the actuator 258C has displaced the valve stem 256C in a downward direction. The valve head 404C of the valve 194C uncovers the outlet port 412C allowing product 262A to flow into the bottle 12. The central portion 416 of the flexible diaphragm 414 is deflected downward into the opening 418 in the wall 274 as the valve stem 256C moves downward. The central portion 416 of the flexible diaphragm 414 remains attached to the valve stem 256C and the peripheral portion 428 of the flexible diaphragm 414 remains attached to the peripheral region 430 of the wall 274 surrounding the opening 418. The flexible diaphragm 414 prevents contaminants from traveling from the non-sterile region 268 to the second sterilization zone 166 of the sterile tunnel 90. Thus, the lower portion 426C of the valve stem 256C remains in the second sterilization zone 166 as the valve stem 256C moves in an upward and downward direction. The initial sterilization process for the second embodiment of the activation mechanism 402C is similar to the process described above for the first embodiment of the activation mechanisms 402A and 402B.

Figure 29:
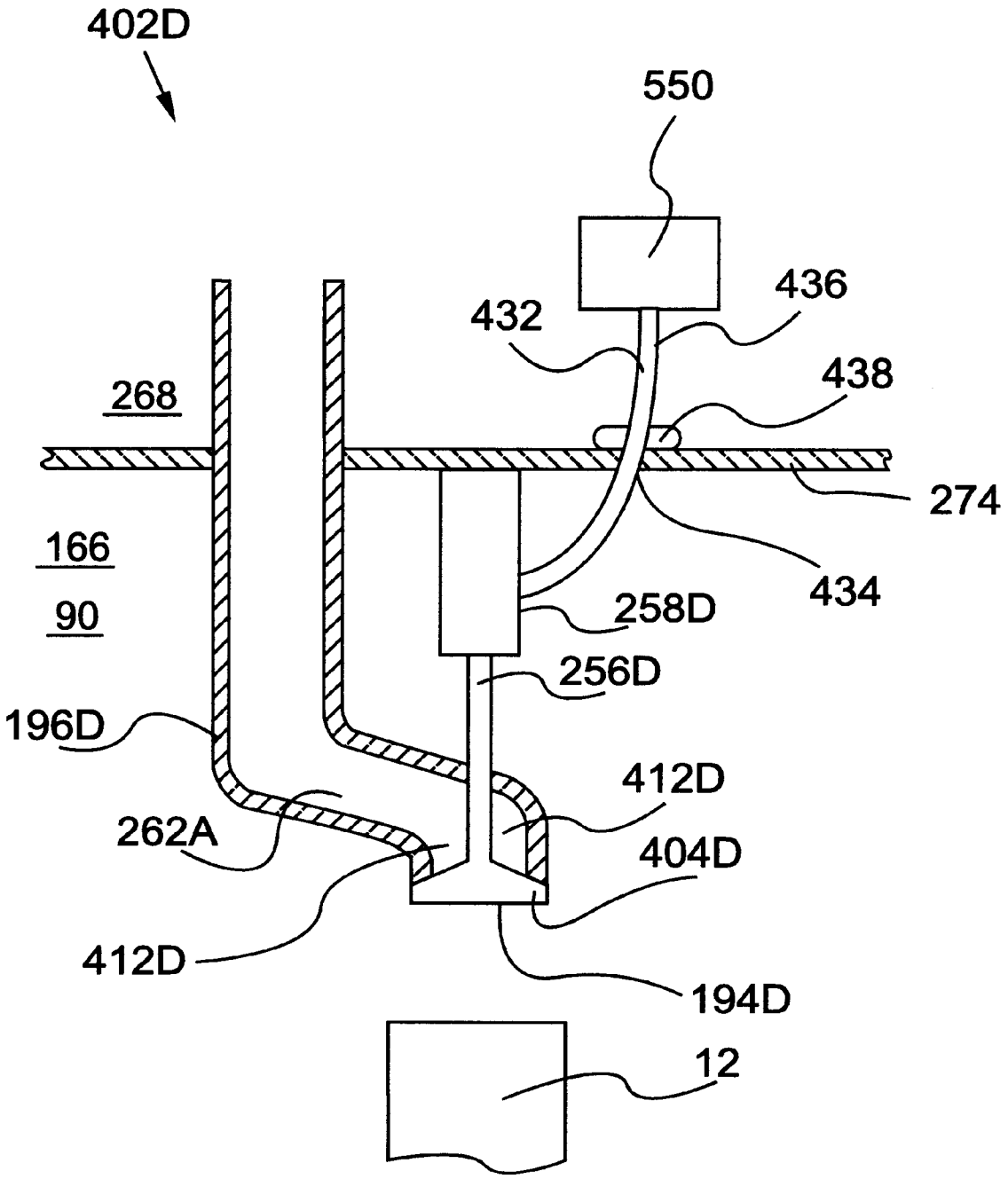
FIG. 29 is a cross-sectional view of a third embodiment of an activation mechanism including a sealed actuator in the sterile tunnel with a valve in a closed position.

FIG. 29 illustrates a third embodiment of an activation mechanism 402D. The activation mechanism 402D for a valve 194D includes a valve stem 256D attached to a sealed actuator 258D. The sealed actuator 258D may include any suitable actuating means (e.g., hydraulic, pneumatic, electrical, etc.). The sealed actuator 258D displaces the valve stem 256D in an upward and downward direction.

As illustrated in FIG. 29, the second sterilization zone 166 of the sterile tunnel 90 (FIG. 3) surrounds a nozzle 196D, the sealed actuator 258D, and an outlet port 412D of the nozzle 196D through which the product 262A exits. The valve 194D includes a valve head 404D that opens and closes the outlet port 412C of the nozzle 196D. The sealed actuator 258D is attached to the wall 274 of the sterile tunnel 90. The sealed actuator 258D is located within the second sterilization zone 166 of the sterile tunnel 90. A control conduit 432 connects the sealed actuator 258D with the control system 550. The control conduit 432 carries a control signal 436 from the control system 550 to the sealed actuator 258D. The control signal 436 directs the sealed actuator 258D to raise or lower the valve stem 256D of the valve 194D. The control conduit 432 passes through an opening 434 in the wall 274 of the sterile tunnel 90. A sealing member 438 (e.g., gasket, grommet, compression fitting, etc.) fills the space between the control conduit 432 and the opening 434, and prevents contaminants from traveling from the non-sterile region 268 to the second sterilization zone 166.

FIG. 29 illustrates the valve 194D in a closed position with the valve head 404D closing the outlet port 412D of the nozzle 196D. The valve head 404D blocks the flow of product 262A into the bottle 12. The bottle 12 is located in the second sterilization zone 166.

Figure 30:
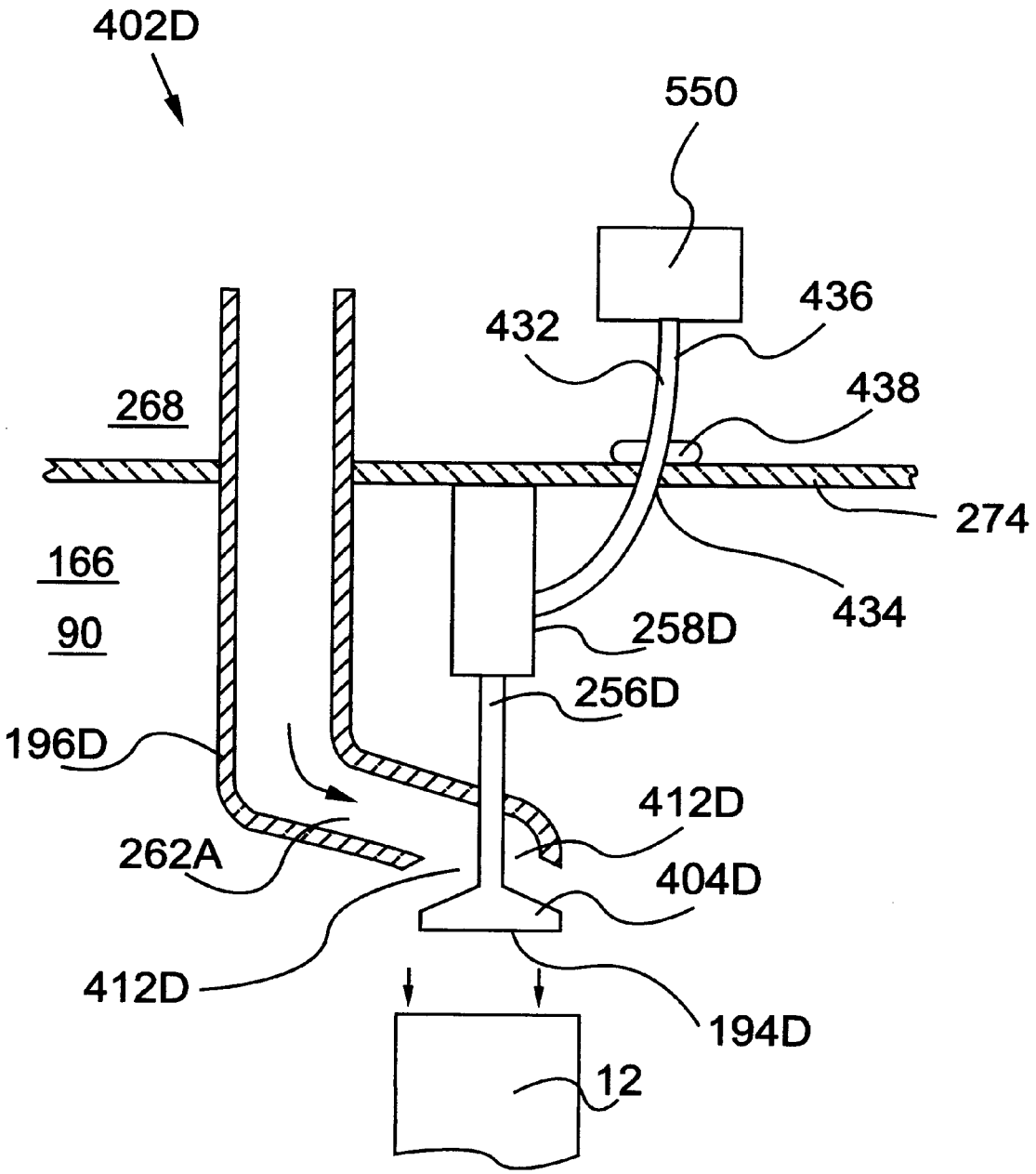
FIG. 30 is a cross-sectional view of the valve of FIG. 29 in an open position.

As illustrated in FIG. 30, the actuator 258D has displaced the valve stem 256D in a downward direction. The valve head 404D of the valve 194D uncovers the outlet port 412D allowing product 262A to flow into the bottle 12. The valve 194D, the valve stem 256D and the sealed actuator 258D remain in the second sterilization zone 166 during actuation of the valve 194D. Thus, no contamination is introduced into the second sterilization zone 166 from the non-sterile zone 268. The initial sterilization process for the third embodiment of the activation mechanism 402D is similar to the process described above for the first embodiment of the activation mechanism 194A.

Figure 31:
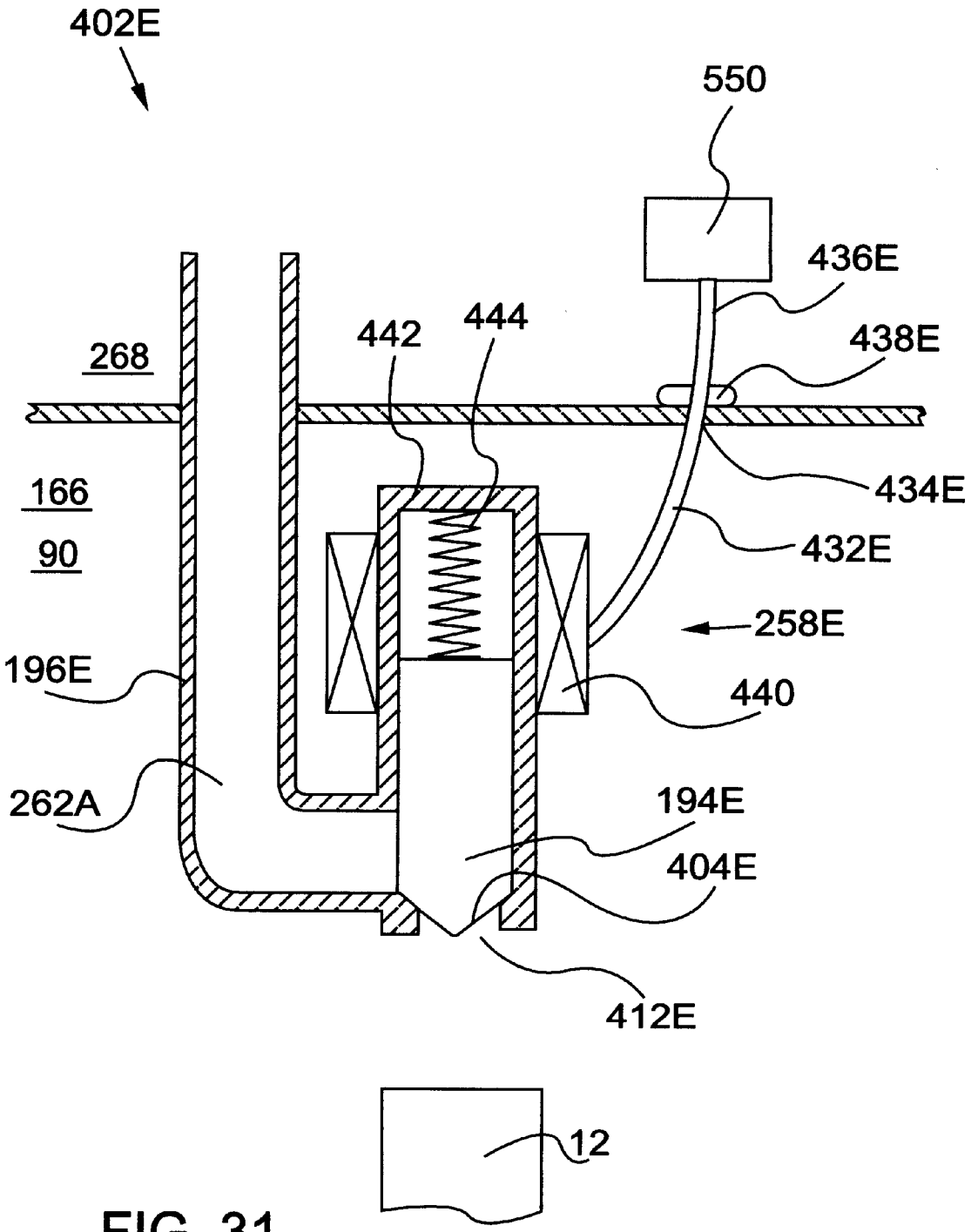
FIG. 31 is a cross-sectional view of a fourth embodiment of an activation mechanism including a sealed actuator with an electromagnet with a valve in a closed position.

FIG. 31 illustrates a fourth embodiment of an activation mechanism 402E. The activation mechanism 402E includes a valve 194E attached to an electromagnet actuator 258E. The electromagnet actuator 258E displaces the valve 194E in an upward and downward direction.

As illustrated in FIG. 31, the second sterilization zone 166 of the sterile tunnel 90 (FIG. 3) surrounds a nozzle 196E, the electromagnet actuator 258E, and an outlet port 412E of the nozzle 196E through which the product 262A exits. The valve 194E includes a valve head 404E that opens and closes the outlet port 412E of the nozzle 196E. The electromagnet actuator 258E is located within the second sterilization zone 166 of the sterile tunnel 90. The electromagnet actuator 258E includes an electromagnet 440, a body 442 and a spring 444. The spring 444 is located between the body 442 and the valve 194E. When electrical current is introduced into the electromagnet 440, the valve 194E is pulled in an upward direction. When the electrical current is removed from the electromagnet 440, the valve 194E is released and the spring 444 forces the valve 194E in a downward direction. A control conduit 432E connects the electromagnet actuator 258E with the control system 550. The control conduit 432E carries the electrical current control signal 436E from the control system 550 to the electromagnet 440 in the electromagnet actuator 258E. The control conduit 432E passes through an opening 434E in the wall 274 of the sterile tunnel 90. A sealing member 438E (e.g., gasket, grommet, compression fitting, etc.) fills the space between the control conduit 432E and the opening 434E, and prevents contaminants from traveling from the non-sterile region 268 into the second sterilization zone 166.

FIG. 31 illustrates the valve 194E in a closed position with the valve head 404E sealing the outlet port 412E of the nozzle 196E. The electromagnet 440 is deactivated and the spring 444 forces the valve 194E downward against the outlet port 412E of the nozzle 196E. The valve head 404E blocks the flow of product 262A into the bottle 12. The bottle 12 is located in the second sterilization zone 166.

Figure 32:
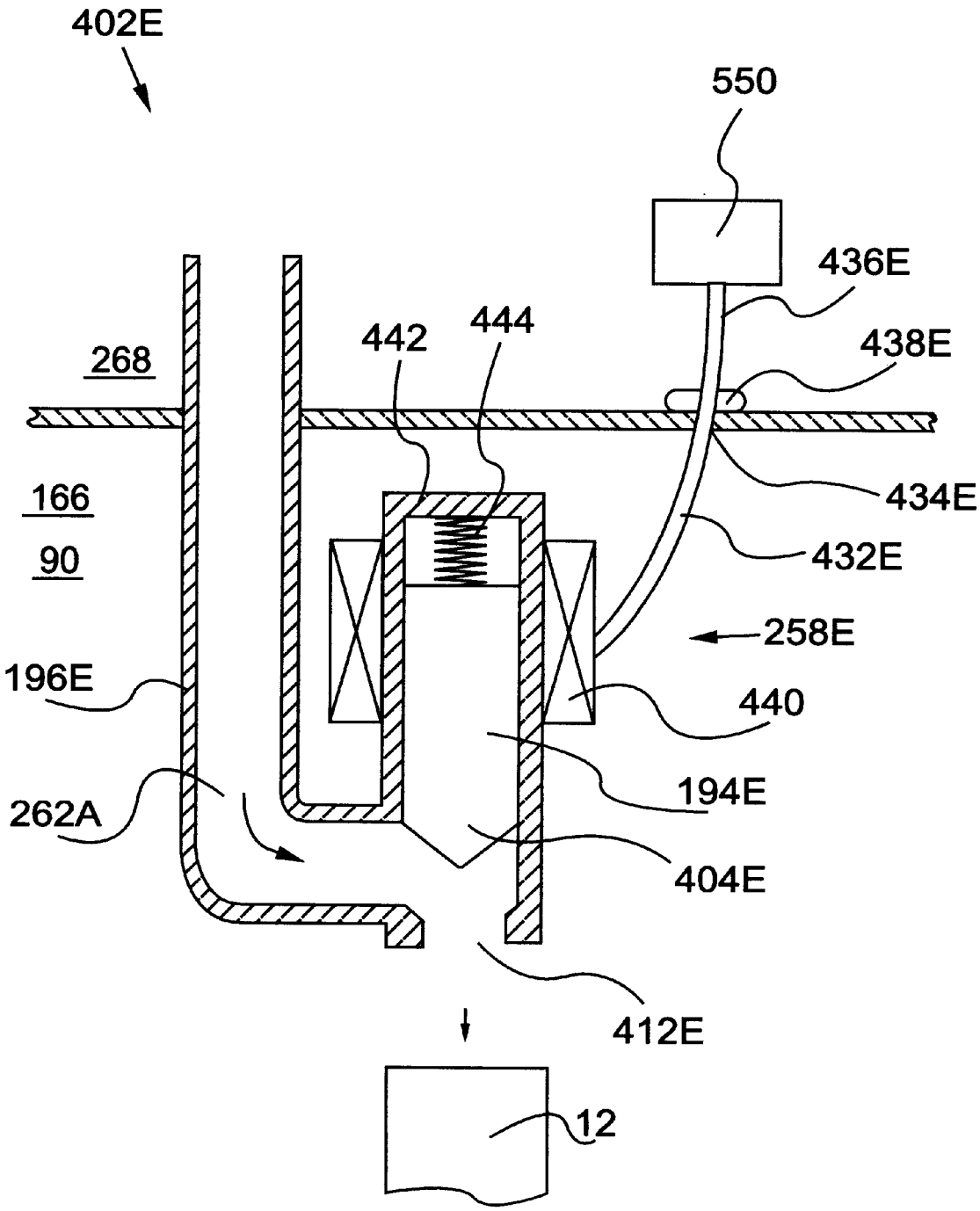
FIG. 32 is a cross-sectional view of the valve of FIG. 32 in an open position.

As illustrated in FIG. 32, an electric current is applied to the electromagnet actuator 258E to displace the valve 194E in an upward direction. The valve head 404E of the valve 194E uncovers the outlet port 412E allowing product 262A to flow into the bottle 12. The valve 194E and the electromagnet actuator 258E remain in the second sterilization zone 166 during actuation of the valve 194E. Thus, no contamination is introduced from the non-sterile zone 268 into the second sterilization zone 166. The initial sterilization process for the fourth embodiment of the activation mechanism 402E is similar to the process described above for the first embodiment of the activation mechanisms 402A and 402B.

Figure 33:
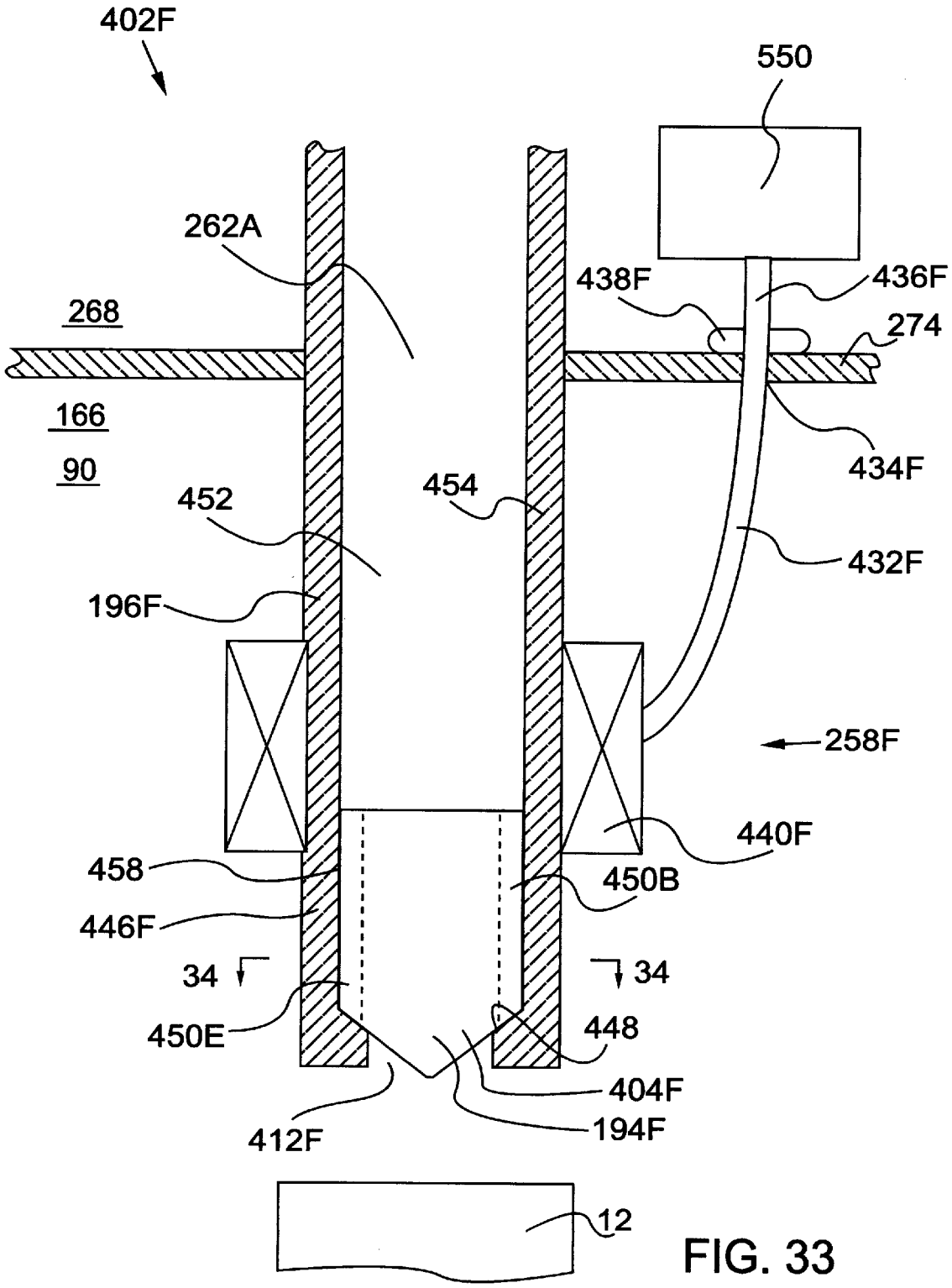
FIG. 33 is a cross-sectional view of a fifth embodiment of an activation mechanism including a sealed actuator with an electromagnet with a valve in a closed position.

FIG. 33 illustrates a fifth embodiment of an activation mechanism 402F. The activation mechanism 402F includes a valve 194F attached to a sealed actuator 258F. The sealed actuator 258F includes an electromagnet 440F that displaces the valve 194F in an upward direction.

Figure 34:
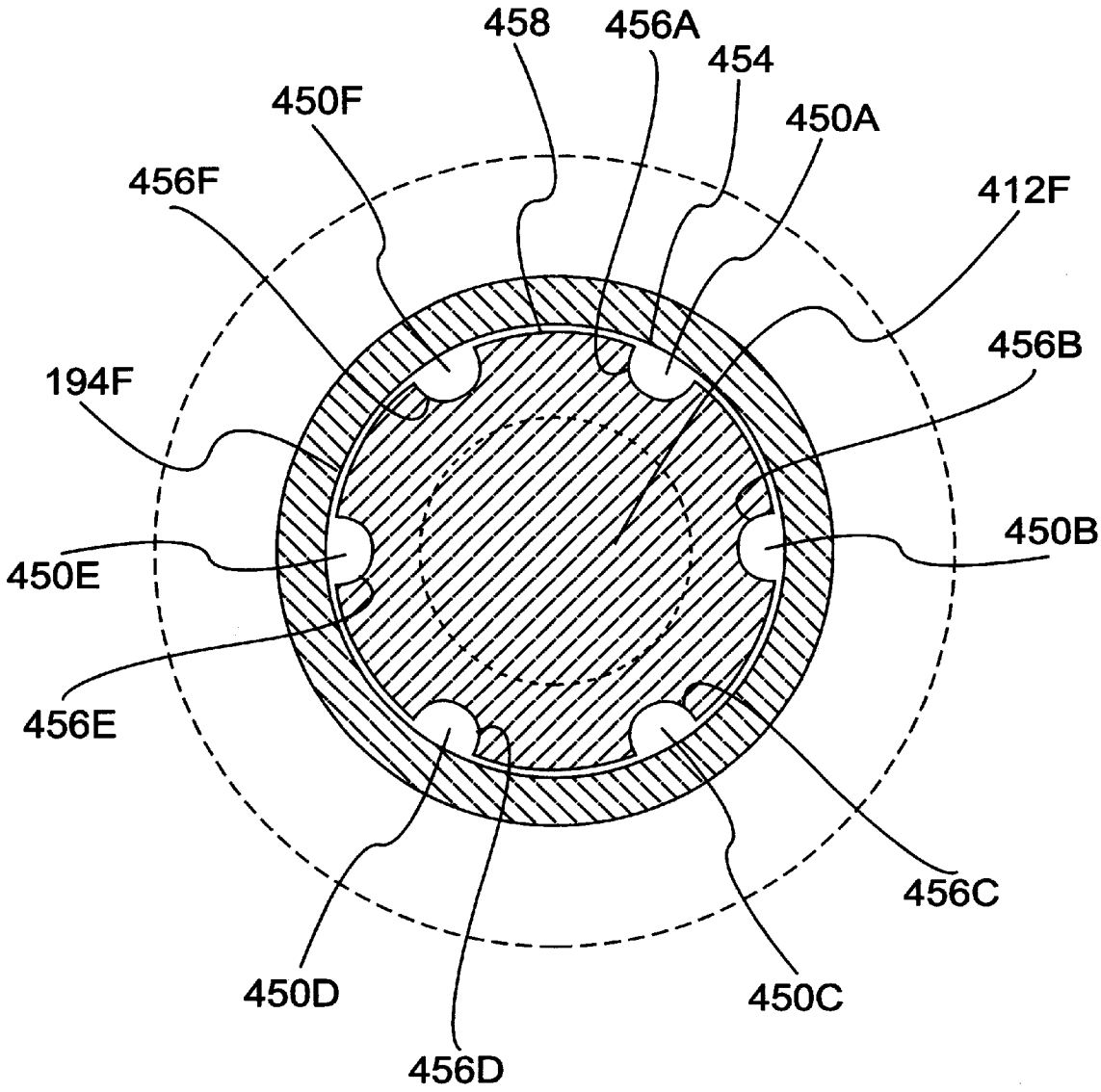
FIG. 34 is a cross-sectional view taken along the line 34—34 as shown in FIG. 33.

As illustrated in FIG. 33, the second sterilization zone 166 of the sterile tunnel 90 (FIG. 3) surrounds a nozzle 196F, the sealed actuator 258F, and an outlet port 412F of the nozzle 196F through which the product 262A exits. The valve 194F includes a valve head 404F that opens and closes the outlet port 412F of the nozzle 196F. The sealed actuator 258F is located within the second sterilization zone 166 of the sterile tunnel 90. The sealed actuator 258F includes the electromagnet 440F and a cylindrical portion 446F of the nozzle 196F. The valve 194F slides up and down in the cylindrical portion 446F of the nozzle 196F. The clearance between the outer surface 458 of the valve 440F and an inner wall 454 of the nozzle 196F is a running fit preventing product 262A flow from leaking past the outer surface 458 of the valve 194F (FIG. 34). When an electrical current 436F is introduced into the electromagnet 440F, the valve 194F is pulled in an upward direction. When the electrical current 436F is removed from the electromagnet 440F, the valve 194F is released and the pressure of the product 262A forces the valve 194F in a downward direction. A control conduit 432F connects the electromagnet 440F of the sealed actuator 258F with the control system 550. The control conduit 432F carries the electrical current 436F from the control system 550 to the electromagnet 440F in the sealed actuator 258F. The control conduit 432F passes through an opening 434F in the wall 274 of the sterile tunnel 90. A sealing member 438F (e.g., gasket, grommet, compression fitting, etc.) fills the space between the control conduit 432F and the opening 434F, and prevents contaminants from traveling from the non-sterile region 268 into the second sterilization zone 166.

Figure 35:
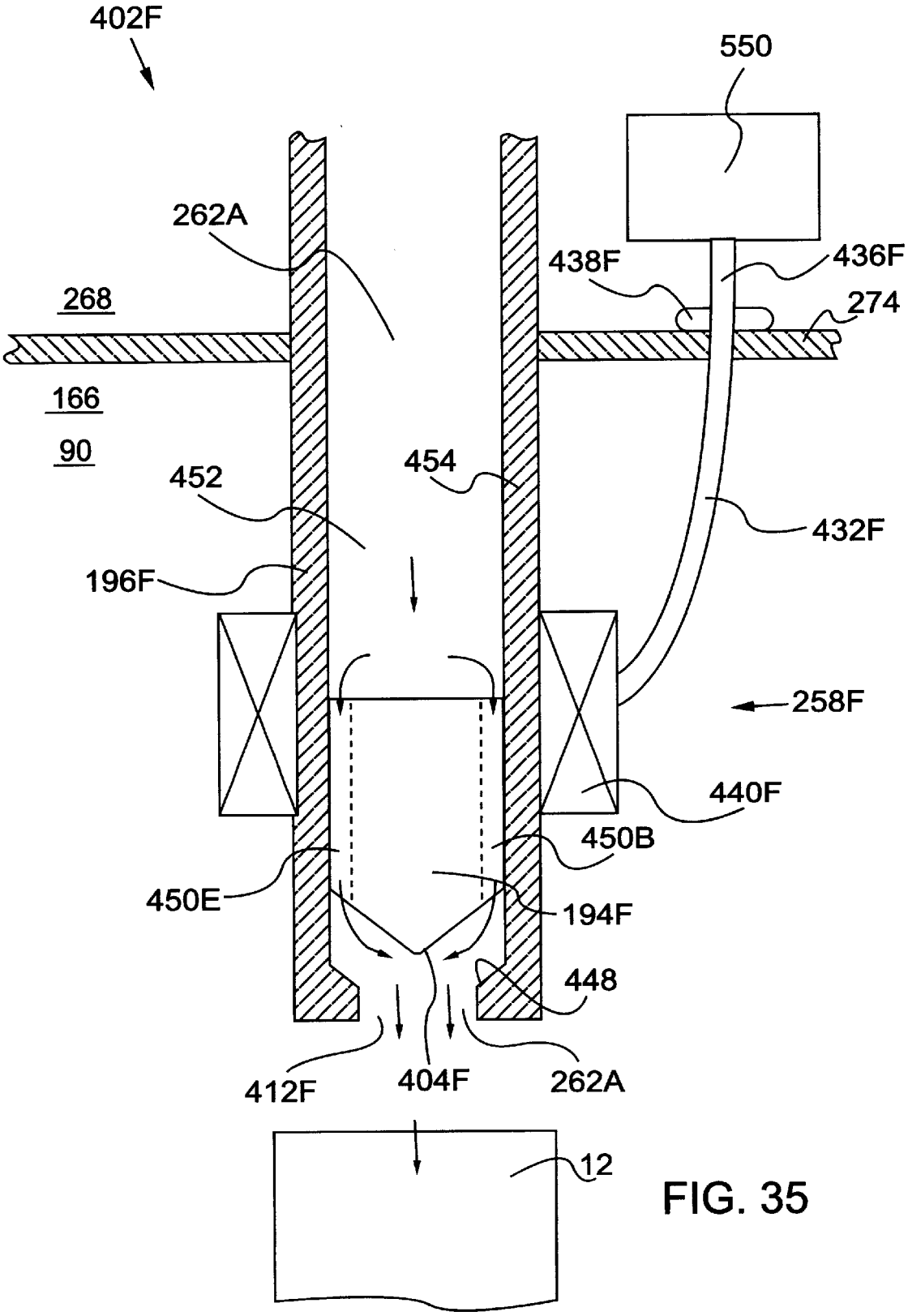
FIG. 35 is a cross-sectional view of the valve of FIG. 33 in an open position.

As illustrated in FIGS. 33–35, the valve 194F includes a plurality of indentations 456A–456F formed on the outer surface 458 of the valve 194F. A plurality of flow passages 450A–450F are formed between the inner wall 454 of the nozzle 196F and the indentations 456A–456F in the valve 194F. The flow passages 450A–450F fill with the product 262A and transport product 262A from an upper portion 452 of the nozzle 196F to the outlet port 412F. FIG. 33 illustrates the valve 194F in a closed position with the valve head 404F pressing against a valve seat 448 of the nozzle 196F. Each indentation 456A–456F is pressed against the valve seat 448 which prevents the product 262A from reaching the outlet port 412F of the nozzle 196F. Thus, product 262A is prevented from flowing from the nozzle 196F to the bottle 12.

As illustrated in FIG. 35, the electrical current 436F is applied to the sealed actuator 258F to displace the valve 194F in an upward direction. The valve head 404F of the valve 194F uncovers the outlet port 412F, and the plurality of indentations 456A–456F are retracted from the valve seat 448. The product 262A flows from the upper portion 452 of the nozzle 196A, through the flow passages 450A–450F, through the outlet port 412F, and into the bottle 12. The sealed actuator 258F and the valve 194F remain within the second sterilization zone 166 during actuation of the valve 194F. Thus, no contamination is introduced from the non-sterile zone 268 into the second sterilization zone 166. The initial sterilization process for the fifth embodiment of the activation mechanism 402F is similar to the process described above for the first embodiment of the activation mechanisms 402A and 402B.

The nozzles 196A–196F of the activation mechanisms 402A–402F, respectively, are supplied aseptic product 262*a* by the pressurized reservoir apparatus 180 of the main product filler apparatus 160 as illustrated in FIGS. 3, 13, and 22. Additionally, as previously described, the pressurized reservoir apparatus 180 includes the product tank 182, the level sensor 184, the pressure apparatus 180, and the volumetric measuring device 188.

FIGS. 3, 13, 16 and 19 illustrate the lid sterilization and heat sealing apparatus 162. A lid 200 is applied to each of the twelve bottles 12 at station 33. For a fully aseptic bottle filler, complete lid 200 sterilization is necessary, and therefore a sterilant such as hydrogen peroxide is typically used. In the present invention, the lids are formed of a material such as foil or plastic. The lids 200 are joined together by a small interconnecting band 203 that holds them together to form a long continuous chain of lids 200, hereinafter referred to as a "daisy chain" 202. The daisy chain 202 of lids is illustrated in FIGS. 17. A daisy chain 202 of lids 200 is placed on each of a plurality of reels 210. For the twelve bottle configuration of the present invention, six of the reels 210, each holding a daisy chain 202 of lids 200, are located on each side of a heat sealing apparatus 214. Each daisy chain 202 of lids 200 winds off of a corresponding reel 210 and is sterilized, preferably using a hydrogen peroxide bath 204. The concentration of hydrogen peroxide can range from about 30 to 40%, however, preferably the concentration is about 35%. Each lid 200 remains in the hydrogen peroxide bath 204 for at least about 6 seconds. A plurality of hot sterile air knives 208, which are formed by jets of hot sterile air, activate the hydrogen peroxide to sterilize the lids 200 on the daisy chain 202. The hot sterile air temperature is about 135° C. The hot air knives 208 also remove excess hydrogen peroxide from the lids 200. A plurality of heated platens 205 further dry the lids 200 so that the residual concentration of hydrogen peroxide is less than 0.5 PPM. The hydrogen peroxide bath 204 prevents any contaminants from entering the sterilization tunnel 90 via the lidding operation.

Once sterilized, the lids 200 enter the sterilization tunnel 90 where they are separated from the daisy chain 202 and placed on a bottle 12. Each lid is slightly larger in diameter then that of the opening 16 of a bottle 12. During the placement of the lid 200 on the bottle 12, a slight mechanical crimp of the lid 200 is formed to locate and hold the lid 200 on the bottle 12. The crimp holds the lid 200 in place on the bottle 12 until the bottle 12 reaches a station 33 for sealing. Sealing may also be accomplished without having to provide the mechanical crimp on the lid 200.

Figure 18:
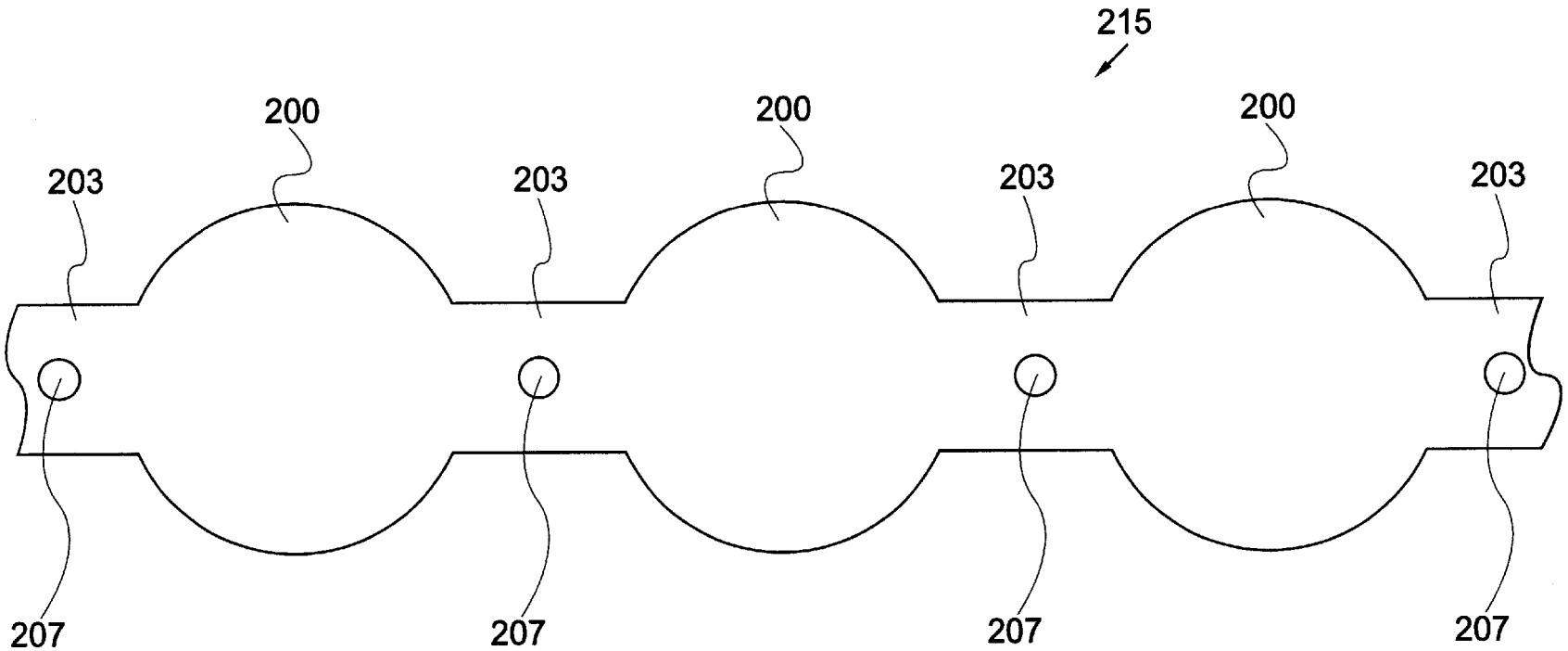
FIG. 18 is a plan view of another embodiment of a daisy chain of lids with holes for receiving pins of a drive wheel.
Figure 19:
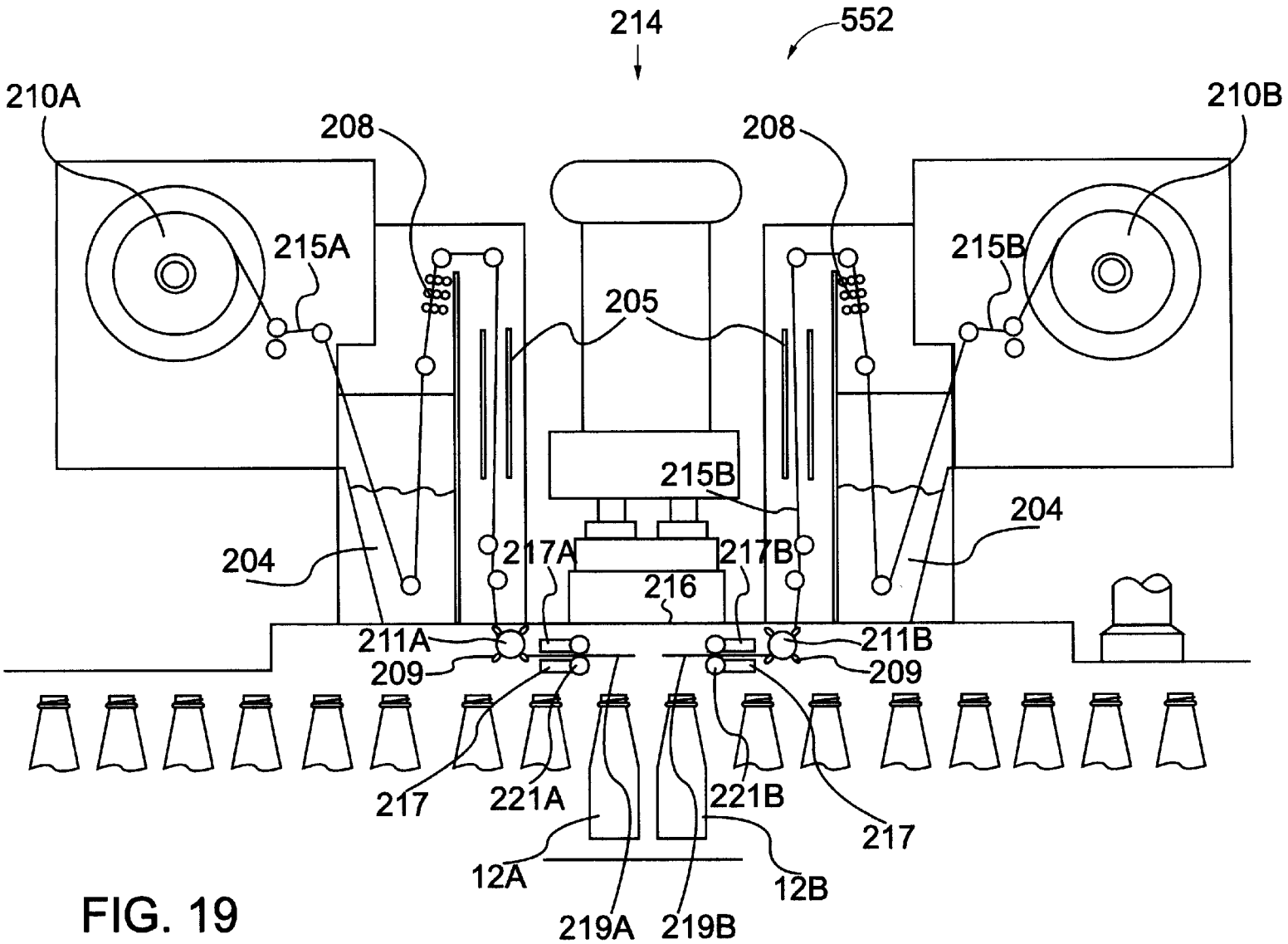
FIG. 19 is another embodiment of the lid sterilization and heat sealing apparatus including a pin drive apparatus.

Another embodiment of a lid sterilization and heat sealing apparatus 552 is illustrated in FIG. 19. As illustrated in FIG. 18, the daisy chain 215 of lids 200 includes a hole 207 located in each interconnecting band 203. Each hole 207 receives a pin 209 of a drive sprocket 211.

The daisy chain 215A, 215B of lids 200 is placed on each of a plurality of reels 210 (e.g. 210A and 210B). For the twelve bottle configuration of the present invention, six of the reels 210, each holding a daisy chain 215A, 215B of lids 200, are located on each side of a heat sealing apparatus 214. Each daisy chain 215A, 215B of lids 200 winds off of a corresponding reel 210 and is sterilized preferably using a hydrogen peroxide bath 204. The concentration of hydrogen peroxide can range from about 30 to 40%, however, preferably the concentration is about 35%. The lids 200 remain in the hydrogen peroxide bath 204 for at least about 6 seconds. A plurality of hot sterile air knives 208, which are formed by jets of hot sterile air, activate the hydrogen peroxide to sterilize the lids 200 on the daisy chain 215A, 215B. The hot sterile air temperature is about 135° C. The hot air knives 208 also remove excess hydrogen peroxide form the lids 200. A plurality of heated platens 205 further dry the lids 200 so that the residual concentration of hydrogen peroxide is less than 0.5 PPM. The hydrogen peroxide bath 204 prevents any contaminants from entering the sterilization tunnel 90 via the lidding operation. The drive sprocket 211A includes a plurality of pins 209 that engage with the holes 207 of the daisy chain 215A. The drive sprocket 211A rotates in a counterclockwise direction and indexes and directs the daisy chain 215A, through a plurality of guides 217A. The guides 217A may include a plurality of rollers 221A to further guide and direct an end 219A of the daisy chain 215A over the bottle 12A. The drive sprocket 211B includes a plurality of pins 209 that engage with the holes 207 of the daisy chain 215B. The drive sprocket 211B rotates in a clockwise direction and indexes and directs the daisy chain 215B through a plurality of guides 217B. The guides 217B may include a plurality of rollers 221B to further guide and direct an end 219B of the daisy chain 215B over the bottle 12B.

Figure 20:
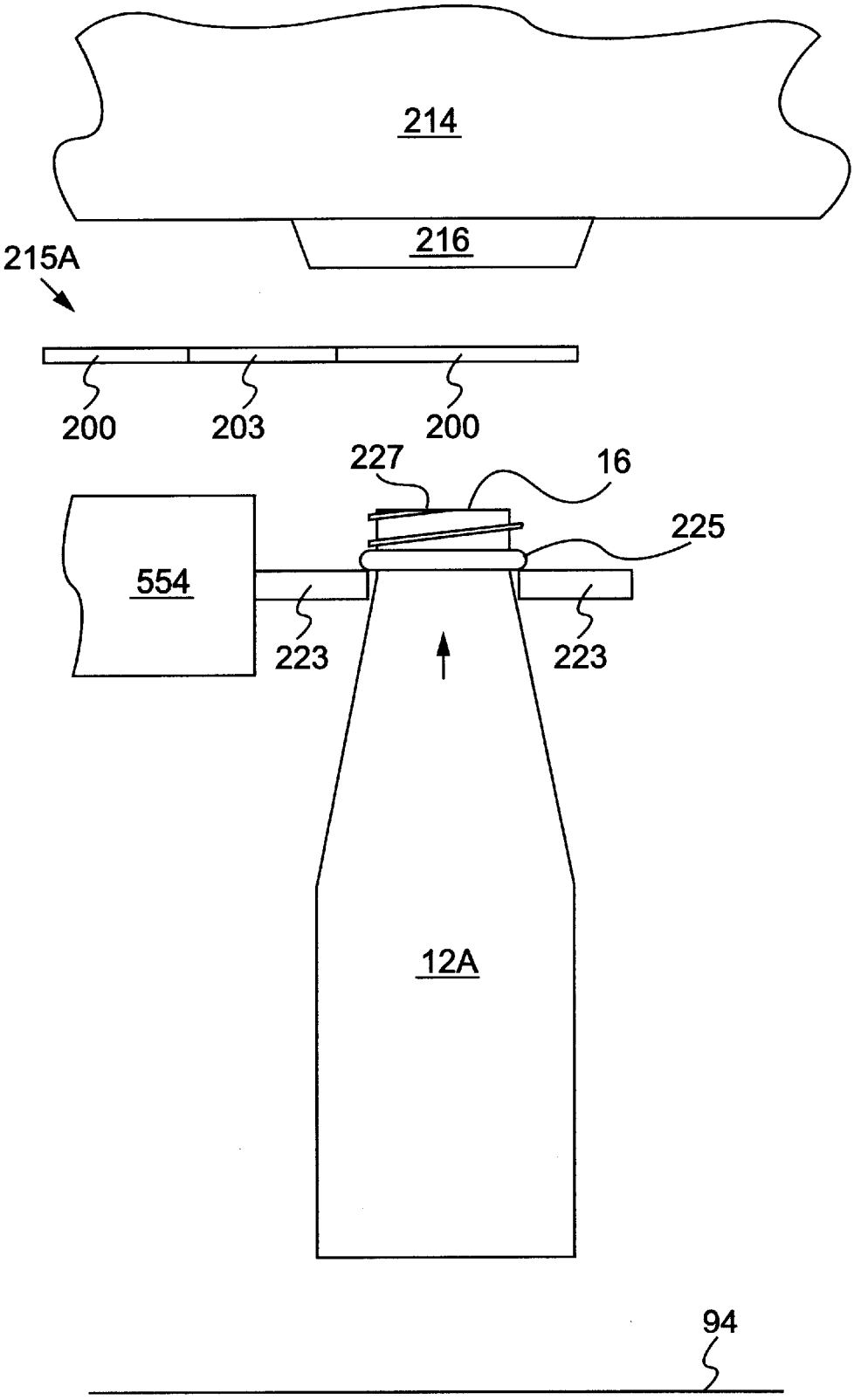
FIG. 20 is a perspective view of the heat sealing and gripper apparatus.

Once sterilized, the lids 200 enter the sterilization tunnel 90 where they are separated from the daisy chain 215A, 217B and placed on the bottle 12A, 12B. At station 33, the lids 200 are applied to the bottles 12. As illustrated in FIGS. 13 and 20, the heat sealing apparatus 214 includes a heated platen 216 that applies heat and pressure against each lid 200 for a predetermined length of time, to form a seal between the lid 200 and the bottle 12A, 12B. Although lidding for a bottle has been described, it should be appreciated that lidding of other containers (e.g. jars) can be provided by the present invention. FIG. 20 illustrates a perspective view of the heat sealing apparatus 214, the daisy chain 215A, the gripper apparatus 554, the bottle 12A, and the conveying plate 94. The lid 200 is located above the bottle opening 16. The gripper apparatus 554 includes a grip 223 for capturing the bottle 12A by a bottle lip 225. The gripper apparatus 554 lifts the bottle 12A in an upward direction so that the lid 200 is pressed between a bottle top lip 227 and the heated platen 216. The interconnecting band 203 severs and separates the lid 200 on the bottle 12 from the next lid on the daisy chain 215A. The heated platen 216 is in a two by six configuration to seal twelve of the bottles 12 at a time. There is a separate gripper apparatus 554 for each of the twelve bottles 12. After each bottle 12 is sealed, its gripper apparatus 554 lowers and releases the bottle 12 and each bottle 12 continues to station 37.

At station 37, the lid 200 seal and bottle 12 integrity are checked in a known manner by a seal integrity apparatus (not shown) comprising, for example, a bottle squeezing mechanism and a proximity sensor. Each bottle 12 is squeezed by the bottle squeezing mechanism which causes the lid 200 on the bottle 12 to extend upward. The proximity sensor detects if the lid 200 has extended upward, which indicates an acceptable seal, or whether the seal remains flat, which indicates a leaking seal or bottle 12. The location of the defective bottles 12 are recorded by the control system 550 so that the defective bottles will not be packed.

Bottle discharge from the sterilization tunnel 90 of the filler apparatus 50 occurs at stations 38 and 40 as illustrated in FIGS. 3, 13 and 14. A bottle discharge apparatus 280 is located at stations 38 and 40. At this point in the filler apparatus 50, the filled and sealed bottles 12 are forced in an upward direction such that a top portion 284 of each bottle 12 protrudes through the opening 282 in the sterilization tunnel 90 (FIG. 14). A rotating cam 290 or other suitable means (e.g., an inflatable diaphragm, etc.) may be used to apply a force against the bottom 120 of each bottle 12 to force the bottle 12 in an upward direction.

As illustrated in FIG. 14, the bottle discharge apparatus 280 comprises a lifting apparatus 286 that includes a gripper 288 that grasps the top portion 284 of each bottle 12 and lifts the bottle 12 out through the opening 282 in the sterilization tunnel 90. In order to ensure that contaminated air cannot enter the sterilization tunnel 90, the sterile air in the sterilization tunnel 90 is maintained at a higher pressure than the air outside the sterilization tunnel 90. Thus, sterile air is always flowing out of the sterilization tunnel 90 through the opening 282. In addition, the gripper 288 never enters the sterilization tunnel 90, because the top portion 284 of the bottle 12 is first lifted out of the sterilization tunnel 90 by the action of the rotating cam 290 before being grabbed by the gripper 288.

FIG. 15 illustrates a top view of the filler apparatus 50 including the bottle infeed and sterilization apparatus 60, the interior bottle sterilization apparatus 116, and the activation and drying apparatus 152. FIG. 15 additionally illustrates the main filler apparatus 160, the lid sterilization and heat sealing apparatus 162, and the bottle discharge apparatus 280.

Referring again to FIGS. 1 and 14, the lifting apparatus 286 lifts the bottles 12 at station 38 and places the bottles 12 in a first lane 292 that transports the bottles 12 to a first capping apparatus 410. In addition, the lifting apparatus 286 lifts the bottles 12 at station 40 and places the bottles 12 in a second lane 294 that transports the bottles 12 to a second capping apparatus 400.

The first capping apparatus 410 secures a cap (not shown) on the top of each bottle 12 in the first lane 292. The second capping apparatus 400 secures a cap on the top of each bottle 12 in the second lane 294. The caps are secured to the bottles 12 in a manner known in the art. It should be noted that the capping process may be performed outside of the sterilization tunnel 90 because each of the bottles 12 have previously been sealed within the sterilization tunnel 90 by the lid sterilization and heat sealing apparatus 162 using a sterile lid 200.

After capping, the bottles 12 are transported via the first and second lanes 292, 294 to labelers 460 and 470. The first labeling apparatus 470 applies a label to each bottle 12 in the first lane 292. The second labeling apparatus 460 applies a label to each bottle 12 in the second lane 294.

From the first labeling apparatus 470, the bottles 12 are transported along a first set of multiple lanes (e.g., 4) to a first case packing apparatus 490. From the second labeling apparatus 460, the bottles 12 are transported along a second set of multiple lanes to a second case packing apparatus 480. Each case packing apparatus 480, 490 gathers and packs a plurality of the bottles 12 (e.g., twelve) in each case in a suitable (e.g., three by four) matrix.

A first conveyor 296 transports the cases output by the first case packer 490 to a first palletizer 510. A second conveyor 298 transports the cases output by the second case packer 480 to a second palletizer 500. A vehicle, such as a fork lift truck, then transports the pallets loaded with the cases of bottles 12 to a storage warehouse.

Referring again to FIG. 3, the main conveyor 106 and each conveying plate 94 are cleaned and sanitized once during each revolution of the main conveyor 106. Specifically, after each empty conveying plate 94 passes around the pulley 108, the conveying plate 94 is passed through a liquid sanitizing apparatus 300 and a drying apparatus 302. The liquid sanitizing apparatus 300 sprays a mixture of a sterilizing agent (e.g., oxonia, (hydrogen peroxide and peroxyacetic acid)) over the entire surface of each conveying plate 94 and associated components of the main conveyor 106. In the drying apparatus 302, heated air with is used to dry the main conveyor 106 and conveying plates 94.

Stations 1 through 40 are enclosed in the sterilization tunnel 90. The sterilization tunnel 90 is supplied with air that is pressurized and sterilized. The interior of the sterilization tunnel 90 is maintained at a pressure higher than the outside environment in order to eliminate contamination during the bottle processing. In addition, to further ensure a sterile environment within the sterilization tunnel 90, the sterile air supply provides a predetermined number of air changes (e.g., 2.5 changes of air per minute) in the sterilization tunnel 90.

Before bottle production is initiated, the bottle infeed and sterilization apparatus 60 and the filler apparatus 50 are preferably sterilized with an aseptic sterilant. For example, a sterilant such as a hot hydrogen peroxide mist may be applied to all interior surfaces of the bottle infeed and sterilization apparatus 60 and the filler apparatus 50. Then, hot sterile air is supplied to activate and remove the hydrogen peroxide, and to dry the interior surfaces of the bottle infeed and sterilization apparatus 60 and the filler apparatus 50.

Figure 16:
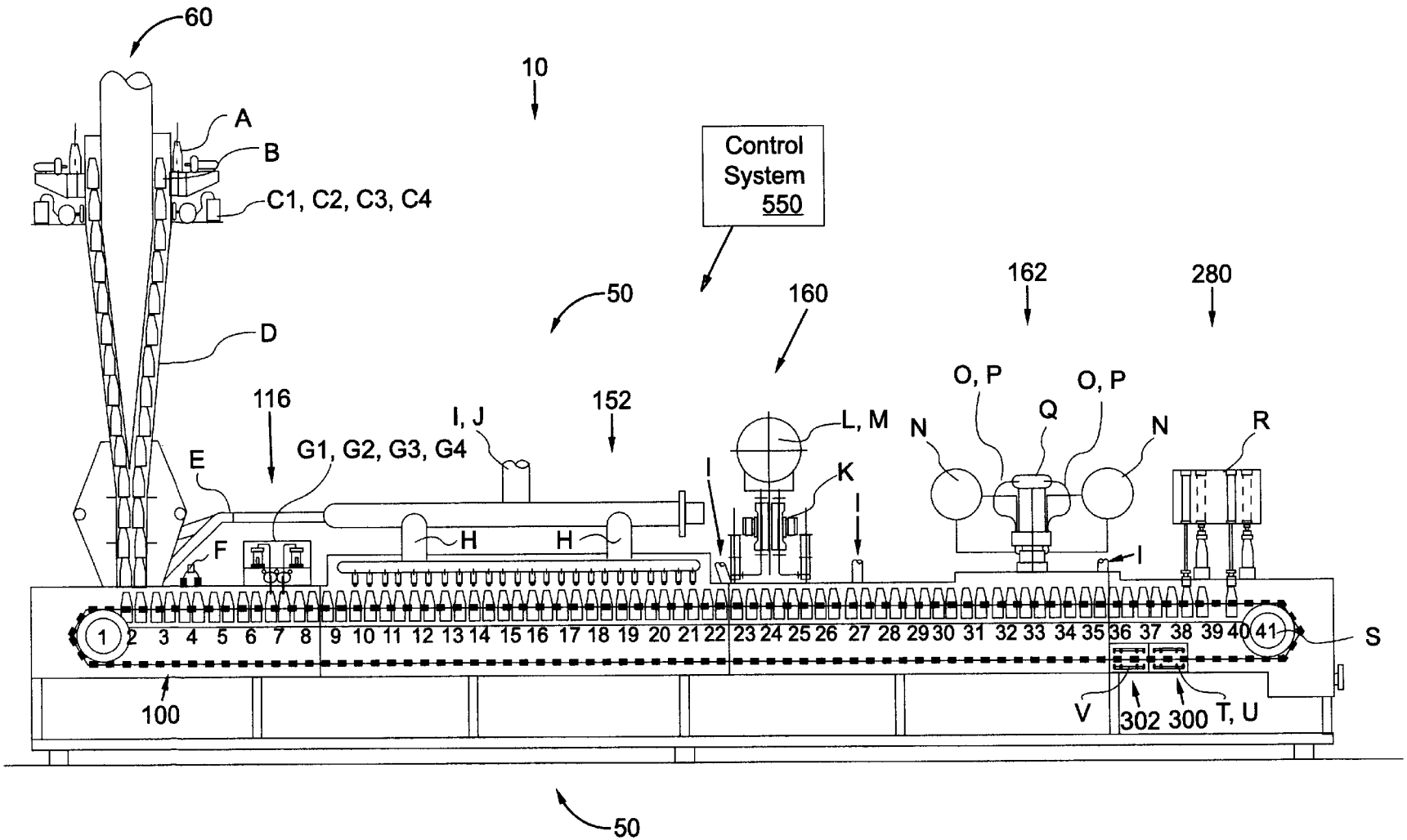
FIG. 16 is a side view of the aseptic processing apparatus indicating the control and monitoring locations that are interfaced with a control system.
Figure 17:
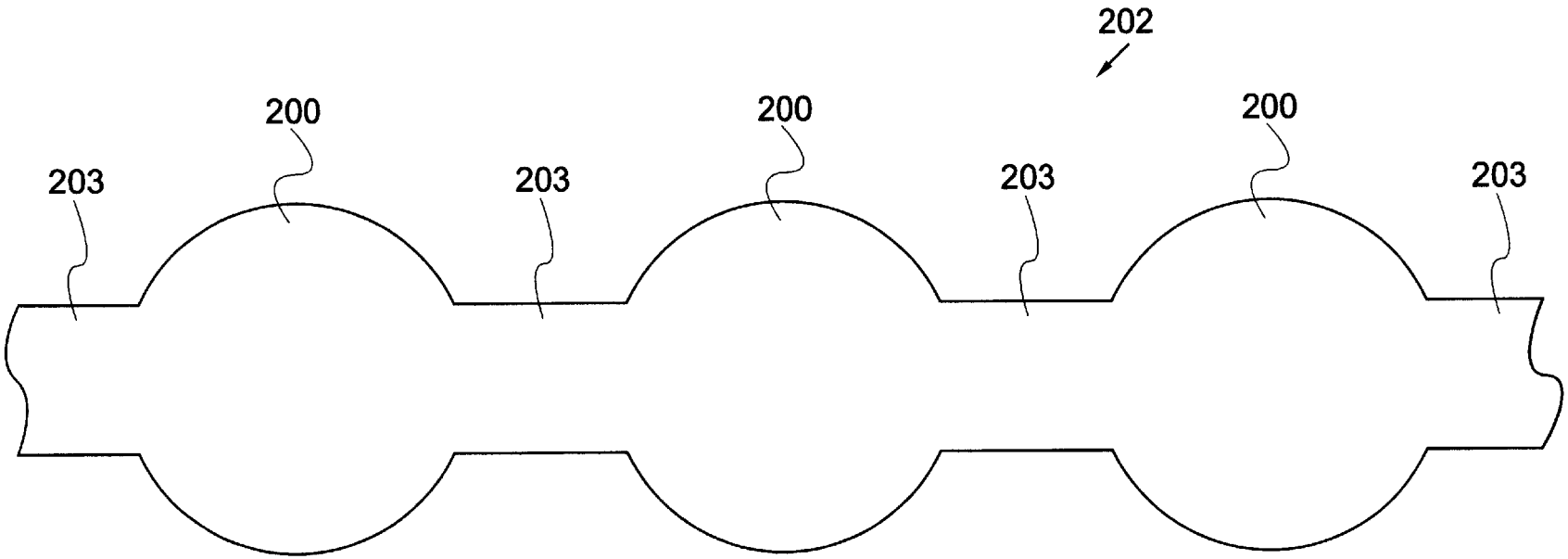
FIG. 17 is a plan view of a daisy chain of lids.

FIG. 16 is a side view of the aseptic processing apparatus 10 of the present invention indicating the location of the control and monitoring devices that are interfaced with the control system 550. The control system 550 gathers information and controls process functions in the aseptic processing apparatus 10. A preferred arrangement of the control and monitoring devices are indicated by encircled letters in FIG. 16. A functional description of each of the control and monitoring devices is listed below. It should be noted that these control and monitoring devices are only representative of the types of devices that may be used in the aseptic processing apparatus 10 of the present invention. Other types and combinations of control and monitoring devices may be used without departing from the intended scope of the present invention. Further, control system 550 may respond in different ways to the outputs of the control and monitoring devices. For example, the control system 550 may automatically adjust the operational parameters of the various components of the aseptic processing apparatus 10, may generate and/or log error messages, or may even shut down the entire aseptic processing apparatus 10. In the preferred embodiment of the present invention, the control and monitoring devices include:

A. A bottle counter to ensure that a predetermined number of the bottles 12 (e.g., six bottles) on each upper horizontal row 24, 28 enter the loading area of the bottle infeed and sterilization apparatus 60.

B. A proximity sensor to ensure that the first group of bottles 12 has dropped into the first bottle position in the bottle infeed and sterilization apparatus 60.

C1. A conductivity sensor to ensure that the measuring cup used by the sterilant application apparatus 36 is full.

C2. A conductivity sensor to ensure that the measuring cup used by the sterilant application apparatus 36 is emptied in a predetermined time.

C3. A pressure sensor to ensure that the pressure of the air used by the sterilant application apparatus 36 is within predetermined atomization requirements.

C4. A temperature sensor to ensure that each heat heating element used by the sterilant application apparatus 36 is heated to the correct temperature.

D. A proximity sensor (e.g., proximity sensor 71, FIG. 3) to ensure that a bottle jam has not occurred within the bottle infeed and sterilization apparatus 60.

E. A temperature sensor to ensure that the temperature of the heated sterile air entering the bottle infeed and sterilization apparatus 60 is correct.

F. A proximity sensor that to ensure that each conveying plate 94 is fully loaded with bottles 12.

G1. A conductivity sensor to ensure that the measuring cup used by the interior bottle sterilization apparatus 116 is full.

G2. A conductivity sensor to ensure that the measuring cup used by the interior bottle sterilization apparatus 116 is emptied in a predetermined time.

G3. A pressure sensor to ensure that the pressure of the air used by the interior bottle sterilization apparatus 116 is within predetermined atomization requirements.

G4. A temperature sensor to ensure that each heat heating element used by the interior bottle sterilization apparatus 116 is heated to the correct temperature.

H. A temperature sensor to ensure that the air drying temperature within the activation and drying apparatus 152 is correct.

I. A plurality of flow sensors to ensure that the airflow rate of the sterile air entering the sterilization tunnel 90 is correct.

J. A pressure sensor to ensure that the pressure of the sterile air entering the activation and drying apparatus 152 is correct.

K. A measuring device (e.g., volumetric measuring device 188, FIG. 3) to ensure that each bottle 12 is filled to a predetermined level.

L. A pressure sensor to ensure that the pressure in the product tank 182 is above a predetermined level.

M. A level sensor to ensure that the level of product in the product tank 182 is maintained at a predetermined level.

N. Proximity sensors to ensure that the daisy chains 202 of lids 200 are present in the lid sterilization and heat sealing apparatus 162

O. A level sensor to ensure that the hydrogen peroxide level in the hydrogen peroxide bath 204 in the lid sterilization and heat sealing apparatus 162 is above a predetermined level.

P. A temperature sensor to ensure that the temperature of the hot sterile air knives 208 of the lid sterilization and heat sealing apparatus 162 is correct.

Q. A temperature sensor to ensure that the heat sealing apparatus 214 is operating at the correct temperature.

R. Proximity sensors to ensure that the bottles 12 are discharged from the filler.

S. A speed sensor to measure the speed of the conveying apparatus 100.

T. A concentration sensor to ensure that the concentration of oxonia is maintained at a predetermined level in the sanitizing apparatus 300.

U. A pressure sensor to ensure that the pressure of the oxonia is maintained above a predetermined level in the sanitizing apparatus 300.

V. A temperature sensor to ensure that the drying temperature of the drying apparatus 302 is correct. The following steps are performed during the "Clean In Place" (CIP) process in the filler apparatus 50.

23. Conductivity sensor to verify caustic and acid concentrations.

24. Temperature sensor to verify "Clean In Place" solution temperatures.

25. Flow meter to verify "Clean In Place" flow rates.

26. Time is monitored to ensure that adequate cleaning time is maintained.

The follow steps are performed during sterilization of the bottle filler apparatus 50;

27. Temperature sensors for measuring steam temperatures.

28. Proximity sensors to ensure filler nozzle cleaning/sterilization cups are in position.

29. Temperature sensors for air heating and cooling.

30. Flow meter for hydrogen peroxide injection.

31. Time is monitored to ensure the minimum time periods are met (steam, hydrogen peroxide application and activation/drying).

The foregoing description of the present invention has been presented for purposes of illustration and description. It is not intended to be exhaustive or to limit the invention to the precise form disclosed, and many modifications and variations are possible in light of the above teaching. Such modifications and variations that may be apparent to a person skilled in the art are intended to be included within the scope of this invention.

I claim:

1. A method comprising:

controlling the flow of an aseptic product using a valve;

surrounding a region where the asepetic product exits the valve with a sterile region wherein the sterile region is a sterile tunnel; and controlling the opening or closing of the valve with a sealed actuator, wherein the sealed actuator is surrounded with the sterile region.

2. The method of claim 1, further including providing a tank for containing a supply of pressurized aseptic product flowing to the valve.

3. The method of claim 2, further including providing a measuring device for measuring the amount of pressurized aseptic product flowing from the tank to the valve.

4. The method of claim 1, further wherein the sealed actuator is partially within the sterile tunnel.

5. The method of claim 1, further wherein the sealed actuator is fully within the sterile tunnel.

6. The method of claim 1, further wherein the sealed actuator is attached to a wall of the sterile tunnel.

7. The method of claim 1, further including:

connecting the sealed actuator to a control system with a control conduit.

8. The method of claim 7, wherein a penetration of the control conduit through a wall of the sterile tunnel is a sealed member.

9. The method of claim 1, further comprising:

aseptically disinfecting a plurality of bottles to a level producing at least about a 6 log reduction in spore organisms.

10. A method comprising:

controlling the flow of an aseptic product using a valve;

surrounding a region where the aseptic product exits the valve with a sterile region;

controlling the opening or closing of the valve with a sealed actuator, wherein the sealed actuator is surrounded with the sterile region; and providing a second apparatus wherein a container is filled to a first level with the product exiting from the first apparatus, and the container is filled to a second level with the product exiting from the second apparatus.

11. The method of claim 10, wherein the container is filled to a first level of at least about 100 containers per minute.

12. The method of claim 11, wherein the container is filled to a second level of at least about 100 containers per minute.

13. The method of claim 10, wherein the aseptic product has been sterilized to a level producing at least about a 12 log reduction in *Clostridium botulinum.*

14. A method comprising:

controlling the flow of an aseptic product using a valve;

surrounding a region where the aseptic product exits the valve with a sterile region;

controlling the opening or closing of the valve with a sealed actuator, wherein the sealed actuator is surrounded with the sterile region;

providing a tank for containing a supply of pressurized aseptic product flowing to the valve;

providing a measuring device for measuring the amount of pressurized aseptic product flowing from the tank to the valve;

exposing the valve, an interior surface of the tank, and an interior surface of the measuring device to steam;

covering an exit of the valve; and allowing a build-up of steam pressure inside the tank to above a temperature of about 250° F., a steam pressure of about 50 psig, for about 30 minutes.

15. A method comprising:

controlling the flow of an aseptic product using a valve;

surrounding a region where the aseptic product exits the valve with a sterile region;

controlling the opening or closing of the valve with a sealed actuator, wherein the sealed actuator is surrounded with the sterile region;

providing a tank for containing a supply of pressurized aseptic product flowing to the valve;

providing a measuring device for measuring the amount of pressurized aseptic product flowing from the tank to the valve;

exposing the valve, an interior surface of the tank, and an interior surface of the measuring device to steam;

covering an exit of the valve;

allowing a build-up of steam pressure inside the tank to above a temperature of about 250° F., a steam pressure of about 50 psig, for about 30 minutes;

uncovering the exit of the valve; and providing sterile air to reduce the temperature of the valve, the interior surface of the tank, and the interior surface of the measuring device to the temperature of the product.

16. A method comprising:

controlling the flow of an aseptic product through a nozzle using a valve;

surrounding a region where the aseptic product exits the valve with a sterile region wherein the sterile region is a sterile tunnel; and displacing the valve with an electromagnetic actuator, wherein an electrical current applied to the electromagnetic actuator displaces the valve into an open position allowing the aseptic product to flow through an outlet port of the nozzle.

17. The method of claim 16, further including providing a pressurized aseptic product into the nozzle.

18. The method of claim 17, further including removing the electric current to the electromagnet actuator allowing the valve to be displaced by the pressurized aseptic product into a closed position sealing the outlet port of the nozzle.

19. A method comprising:

controlling the flow of an aseptic product through a nozzle using a valve wherein an outer surface of the valve includes indentations for forming aseptic product flow passages between an inner wall of the nozzle and the outer surface of the valve for transporting the aseptic product to the outlet port of the nozzle;

surrounding a region where the aseptic product exits the valve with a sterile region; and displacing the valve with an electromagnetic actuator, wherein an electrical current applied to the electromagnetic actuator displaces the valve into an open position allowing the aseptic product to flow through an outlet port of the nozzle.

20. A method comprising:

aseptically disinfecting a plurality of containers in a sterile tunnel;

controlling the flow of an aseptic product into the plurality of containers using a valve;

surrounding a region where the aseptic product exits the valve with a sterile region wherein the sterile region is the sterile tunnel; and controlling the opening or closing of the valve with a sealed actuator, wherein the sealed actuator is surrounded with the sterile region.

21. The method of claim 20, wherein the aseptically disinfecting is to a level producing at least about a 6 log reduction in spore organisms.

22. The method of claim 20, wherein the aseptic product has been sterilized to a level producing at least about a 12 log reduction in *Clostridium botulinum*.

23. The method of claim 20, wherein the plurality of containers are filled at least about 100 containers per minute.

24. A method comprising:

controlling the flow of an aseptic product using a valve;

surrounding a region where the aseptic product exits the valve with a sterile region;

controlling the opening or closing of the valve with a sealed actuator, wherein the sealed actuator is surrounded with the sterile region; and providing a second apparatus wherein an aseptically disinfected container is filled to a first level with the product exiting from a first apparatus, and the container is filled to a second level with the product exiting from the second apparatus, wherein the exiting of the aseptic product and the aseptic disinfecting of the container occur in the same sterile region.

25. The method of claim 24, wherein the aseptically disinfecting is to a level producing at least about a 6 log reduction in spore organisms.

26. The method of claim 24, wherein the aseptic product has been sterilized to a level producing at least about a 12 log reduction in *Clostridium botulinum*.

27. The method of claim 24, wherein a plurality of containers are filled at least about 100 containers per minute.

28. A method comprising:

controlling the flow of an aseptic product using a valve;

filling an aseptically disinfected container with the aseptic product;

surrounding a region where the aseptic product exits the valve with a sterile region, wherein the exiting of the aseptic product and aseptic disinfecting of the container occur in the sterile region;

controlling the opening or closing of the valve with a sealed actuator, wherein the sealed actuator is surrounded with the sterile region;

providing a tank for containing a supply of pressurized aseptic product flowing to the valve;

providing a measuring device for measuring the amount of pressurized aseptic product flowing from the tank to the valve;

exposing the valve, an interior surface of the tank, and an interior surface of the measuring device to steam;

covering an exit of the valve; and allowing a build-up of steam pressure inside the tank to above a temperature of about 250° F., a steam pressure of about 50 psig, for about 30 minutes.

29. The method of claim 28, wherein the aseptically disinfecting is to a level producing at least about a 6 log reduction in spore organisms.

30. The method of claim 28, wherein the aseptic product has been sterilized to a level producing at least about a 12 log reduction in *Clostridium botulinum*.

31. The method of claim 28, wherein containers are filled at least about 100 containers per minute.

32. A method comprising:

controlling the flow of an aseptic product using a valve;

filling an aseptically disinfected container with the aseptic product;

surrounding a region where the aseptic product exits the valve with a sterile region, wherein the exiting of the aseptic product and aseptic disinfecting of the container occur in the sterile region;

controlling the opening or closing of the valve with a sealed actuator, wherein the sealed actuator is surrounded with the sterile region;

providing a tank for containing a supply of pressurized aseptic product flowing to the valve;

providing a measuring device for measuring the amount of pressurized aseptic product flowing from the tank to the valve;

exposing the valve, an interior surface of the tank, and an interior surface of the measuring device to steam;

covering an exit of the valve;

allowing a build-up of steam pressure inside the tank to above a temperature of about 250° F., a steam pressure of about 50 psig, for about 30 minutes;

uncovering the exit of the valve; and providing sterile air to reduce the temperature of the valve, the interior surface of the tank, and the interior surface of the measuring device to the temperature of the product.

33. method of claim 32, wherein the aseptically disinfecting is to a level producing at least about a 6 log reduction in spore organisms.

34. The method of claim 32, wherein the aseptic product has been sterilized to a level producing at least about a 12 log reduction in *Clostridium botulinum.*

35. The method of claim 32, wherein containers are filled at least about 100 containers per minute.

* * * * *